US007784405B2

(12) United States Patent
Rose et al.

(10) Patent No.: US 7,784,405 B2
(45) Date of Patent: Aug. 31, 2010

(54) VEHICLE TRANSFER DURING OPERATION OF AN OMNIMOVER RIDE

(75) Inventors: Christopher J. Rose, Canyon Country, CA (US); David W. Crawford, Long Beach, CA (US)

(73) Assignee: Disney Enterprises, Inc., Burbank, CA (US)

( * ) Notice: Subject to any disclaimer, the term of this patent is extended or adjusted under 35 U.S.C. 154(b) by 275 days.

(21) Appl. No.: 12/109,195

(22) Filed: Apr. 24, 2008

(65) Prior Publication Data

US 2009/0269175 A1 Oct. 29, 2009

(51) Int. Cl.
*B61K 1/00* (2006.01)

(52) U.S. Cl. ..... 104/20; 104/31; 104/35

(58) Field of Classification Search ..... 104/20, 104/21, 27, 28, 30, 31, 35, 48, 49, 53, 74, 104/76

See application file for complete search history.

(56) References Cited

U.S. PATENT DOCUMENTS

| | | | | | |
|---|---|---|---|---|---|
| 3,554,130 | A | | 1/1971 | Broggle | |
| 3,710,725 | A | * | 1/1973 | Pinfari et al. | 104/35 |
| 3,865,041 | A | * | 2/1975 | Bacon | 104/20 |
| 3,929,076 | A | * | 12/1975 | McRae et al. | 104/25 |
| 4,050,385 | A | | 9/1977 | Gurr | |
| 4,370,086 | A | * | 1/1983 | Barry | 414/337 |
| 4,543,886 | A | * | 10/1985 | Spieldiener et al. | 104/53 |
| 4,746,257 | A | * | 5/1988 | Barry | 414/392 |
| 5,069,140 | A | | 12/1991 | Glassey | |
| 5,731,705 | A | * | 3/1998 | Guinn | 335/291 |
| 5,884,563 | A | | 3/1999 | Sheldon | |
| 5,935,011 | A | | 8/1999 | Morgan et al. | |
| 6,074,306 | A | | 6/2000 | Behringer | |
| 6,149,528 | A | | 11/2000 | Volz et al. | |
| 6,340,280 | B1 | | 1/2002 | Mollick et al. | |
| 6,364,594 | B1 | | 4/2002 | Kagan et al. | |
| 6,517,443 | B1 | | 2/2003 | Villella | |

* cited by examiner

*Primary Examiner*—S. Joseph Morano
*Assistant Examiner*—Zachary Kuhfuss
(74) *Attorney, Agent, or Firm*—Marsh Fischmann & Breyfogle LLP; Kent A. Lembke

(57) ABSTRACT

An assembly for transferring passenger-carrying vehicles to and from an amusement park ride conveying a train of vehicles without stopping for passenger loading. The assembly includes a transfer vehicle and a vehicle receiver positioned in the vehicle train. The vehicle receiver includes a connection mechanism, such as an electromagnet selectively operable to capture and release the transfer vehicle. A turntable is positioned adjacent to the track and selectively rotates at a rotation rate. The turntable includes an engagement mechanism, such as an electromagnet, on its periphery operable to capture and release the transfer vehicle (e.g., to capture when the vehicle receiver releases and vice versa). The rotation rate and the ride speed synchronize turntable rotation with travel of the train to mesh placement of the turntable engagement mechanism proximate to the connection mechanism of the vehicle receiver to facilitate hand off of the transfer vehicle without stopping the vehicle train.

45 Claims, 12 Drawing Sheets

VEHICLE TRANSFER DURING OPERATION OF AN OMNIMOVER RIDE

BACKGROUND OF THE INVENTION

1. Field of the Invention

The present invention relates, in general, to providing park guests with disabilities or reduced mobility such as the very young and elderly with enhanced access to amusement park rides, and, more particularly, to vehicle and track designs and systems to provide passengers with disabilities such as those that use wheelchairs with a relatively seamless access to a synchronous ride (e.g., an omnimover ride) without stopping the ride or interrupting flow of the ride and an associated show or attraction.

2. Relevant Background

Amusement parks continue to be popular worldwide with hundreds of millions of people visiting the parks each year. Historically, amusement park operators provided walk-through attractions that presented artwork, music/soundtracks, and effects with museum, haunted house, and other themes. These attractions were popular with many guests of the parks, but park operators had difficulty increasing the daily capacity of such attractions because many guests would linger in various portions of the attraction or even reverse direction in an attempt to visit prior portions of the attraction. As a result, walk-through attractions have generally been replaced by attractions in which the guests ride in vehicles along a track or path through the attraction.

The omnimover is a ride system that has been developed to provide an experience that is similar to a walk-through experience or ride-through tour as it moves guests at speeds similar to walking speed such as less than about 2 feet per second. The omnimover is a ride system used for theme park attractions such as haunted houses in which two, three, or more guests sit in a vehicle that is towed or moved along a track. The omnimover ride system includes a large number of such vehicles that are each attached or linked to a chain. The vehicle chain moves along a track and may be hidden beneath a floor with the vehicles riding on wheels or bogies mating with a track (or pair of rails like a train track). Additional control rails may be provided to control individual rotation or swivel of the vehicles to orient the guests toward various show features and to keep the vehicles level as the track ascends or descends on sloped portions of the attraction.

Omnimover attractions differ from many other ride systems because they are synchronous with the show features such as the soundtrack and special effects such as the display of a ghost or other visual displays being closely timed or synchronized with the movement of the vehicles. In contrast, roller coaster and many other amusement park rides are asynchronous because each vehicle or sets of vehicles can experience the ride separately without effecting the show experience of other vehicles. To support vehicle location and show synchronization in omnimovers, the vehicles are positioned on specific locations on the vehicle chain (e.g., neighboring vehicles are typically closely spaced) to provide a knows, fixed spacing. Also, the train of vehicles is kept in continuous and predictable motion by ongoing or constant movement of the vehicle chain at typically a constant speed throughout the entire course of the attraction.

In addition to maintaining a ride's capacity, park operators are faced with the challenge of providing an enjoyable ride and park experience to guests with disabilities or handicaps. For example, many guests may use wheelchairs, walkers, or otherwise have difficulty in loading and unloading ride vehicles as quickly as other guests. Significant efforts have been made by many park operators to design vehicles that are accessible to or can receive a wheelchair. However, these efforts typically are used for asynchronous rides such as roller coasters and water rides, and the ride does not have to be stopped to physically transfer or insert the loaded vehicle onto the track. In contrast, loading handicapped guests onto omnimover rides is extremely challenging since all vehicles are connected to the vehicle chain at particular locations and the ride is designed for constant movement of the chain at a particular speed. Standard loading and unloading occur with guests standing on a loading belt that is moving at the chain/vehicle speed entering adjacent vehicles and, at a different location or station, guests in vehicles exiting a moving vehicle onto an adjacent unloading belt that is moving at the speed of the chain/vehicle.

Presently, park operators provide access to handicapped guests by slowing or stopping the entire ride system to allow the guest sufficient time to safely transfer (e.g., load and unload) into a custom vehicle. This loading process is undesirable for a number of reasons. It is undesirable from a creative or storytelling standpoint to stop an omnimover ride system because the story flow is broken or interrupted at both loading and unloading and guests in the vehicles within the attraction are taken out of the illusion or magic of the ride when they see a constant/still show effect or one that is repeated or actuated multiple times in front of their stopped vehicle. Also, there may be public announcements informing guests why the vehicle has been halted and urging them to remain seated. However, safety is a concern during such loading because guests in stopped vehicles may be inclined to get out of their vehicles especially near an unloading belt or station, which may result in injuries or potentially harmful situations. Further, the handicapped guest is often impacted by such loading because they understand that they are impacting the other guests' experience, which can cause them to feel uncomfortable or otherwise decrease their enjoyment of the attraction or ride as they receive often unwanted attention.

SUMMARY OF THE INVENTION

The present invention addresses the above problems by providing a vehicle transfer system that is adapted for use on amusement park rides that use omnimover technology or other synchronous ride systems. In omnimover and other synchronous rides, a train (or set of ride vehicles) is created with numerous vehicles linked together (e.g., all the vehicles used in the ride) via a chain or to each other with tow bars and the train of vehicles is not stopped for loading or unloading but is instead typically run at a constant speed such as up to 1 to 2 feet per second or more throughout the ride or attraction.

The vehicle transfer system of the invention provides embodiments that allow a vehicle, which may be a specially adapted transfer vehicle, to be selectively transferred into and out of the moving train without slowing the train from its designated ride speed. For example, a transfer vehicle receiver may be provided within the train of conventional omnimover or synchronous vehicles in the train. A mechanism such as a turntable or the like may be provided at a loading station and a transfer vehicle, such as one adapted for containing a wheel chair with a handicapped or disabled passenger or guest, may be provided on the turntable or at least temporarily connected or supported by the turntable. The transfer vehicle is loaded with one or more special needs guests (e.g., those guests requiring additional time to load and unload and their companions). A control system may be provided in the vehicle transfer system that can be used by a ride operator to initiate a vehicle transfer sequence that includes indicating a loaded vehicle is ready for transfer, sensing the location/presence of an empty/available receiver approaching in the vehicle train, operating the turntable in a synchronized manner with the movement or speed of the vehicle train and location of the available receiver to rotate the turntable so as to cause the transfer vehicle and the receiver to come into contact (or mechanisms of the receiver and the transfer vehicle to mesh or interact), and transferring the vehicle onto the vehicle receiver. Unloading is performed in a similar manner with the sensing by the control system of an approaching loaded vehicle and operating the turntable to have an empty unloading arm/mechanism rotate into contact or proximity with the receiver to unload the vehicle onto the turntable of the vehicle transfer system.

A variety of mechanisms and techniques may be used in the vehicle transfer systems of the invention to accomplish this vehicle handoff operation or loading/unloading between a receiver and a turntable with some using purely mechanical assemblies with meshing/interlatching or connecting components provided on the transfer vehicle body and receiver while others utilize magnets provided on the transfer vehicle, the turntable, and the receiver to selectively, such as with electromagnets operated by the control system, attach the vehicle to the turntable or the receiver. Typical embodiments call for placing a transfer vehicle body onto a vehicle receiver, but embodiments may also include removing an entire car from the moving train and replacing it with another car or the same car/vehicle after it has been unloaded and loaded with additional passengers. In such cases, the "receiver" may be thought of as simply the connection assembly or point on the towing system (e.g., a vehicle chain used in an omnimover) where a loaded vehicle may be attached. In other words, the particular technique used for attaching a loaded transfer vehicle to the moving train may be varied significantly to practice the invention once the concept of a loading station of the invention is understood. Briefly stated, a loading station of the invention is typically configured such that it can be run asynchronously during vehicle loading and unloading, e.g., to allow a disabled person to load/unload at their leisure, and then later synchronized with train movement and position of a receiver to place (or remove) the vehicle in (or from) the train without slowing or stopping the ride. In this manner, the vehicle transfer system is effective at facilitating vehicle transfer to support a walk-through type ride such as an omnimover ride in which a show may be closely tied to the continuously moving vehicles.

More particularly, an assembly is provided for transferring vehicles to and from an amusement park ride, which is operated to convey a train of vehicles along a track at a substantially continuous ride speed without interruption for loading and unloading of passengers. The assembly includes a transfer vehicle with a body configured for receiving one or more passengers. A vehicle receiver is positioned in the train to be conveyed with the vehicles on the track. The vehicle receiver includes a connection mechanism that is selectively operable to capture and release the transfer vehicle. The transfer assembly further includes a turntable positioned adjacent to the track that is also selectively operable to rotate about a central hub at a rotation rate. The turntable includes an engagement mechanism at a position on the periphery or edge of the turntable that is selectively operable to capture and release the transfer vehicle (e.g., to capture when the vehicle receiver releases and vice versa). The rotation rate is selected based on the ride speed so as to synchronize the rotation of the turntable with the travel of the train of vehicle to place the turntable engagement mechanism proximate to the connection mechanism of the vehicle receiver to facilitate proper hand off of the transfer vehicle without stopping the train of vehicles or the turntable.

In some embodiments, the transfer assembly also includes a ride control system with a sensor sensing a position of the vehicle receiver on the track relative to the turntable. In response, the ride control system initiates operation of the turntable (or a driver of such turntable) to rotate at the rotation rate to provide the desired synchronized rotation with the travel of the train of vehicles (e.g., to place the turntable engagement mechanism adjacent, over, or near the connection mechanism on the receiver as the receiver is conveyed along the track at the ride speed). The ride control system may also include one or more sensors that function to determine or verify when the turntable engagement mechanism is properly located or aligned proximate to the connection mechanism of the vehicle receiver (or to determine the transfer vehicle is in the transfer or hand off position). In response, the ride control system may operate the turntable engagement mechanism and the connection mechanism (concurrently or sequentially) to transfer the vehicle between the turntable and the vehicle receiver (in either direction).

The turntable may be generally circular in shape and/or include a transfer arm that extends outward from the general diameter so as to place at least a portion of the turntable into the travel path of the train of vehicles, and, in such embodiments, the engagement mechanism typically would be positioned at or near the end of this transfer arm. The transfer vehicle may include a connection plate (or magnetic plate) extending from the body (such as from its base) and that is formed of a material such as iron, steel, or another metal or alloy that is attracted to (or susceptible to) magnetic fields or forces. In these cases, the connection mechanism and the engagement mechanism may each include one or more electromagnets that are selectively operable or energized to capture and release the connection plate of the transfer vehicle so as to physically support the transfer vehicle. To facilitate the handoff or transfer, the vehicle receiver and the turntable may be physically shaped/configured such that when the turntable engagement mechanism and the connection mechanism of the vehicle receiver are placed in proximity or adjacent to each other, the connection plate (and/or other connection elements or members) of the transfer vehicle is positioned or disposed between these two mechanisms such as between the two electromagnets.

A stabilizer element or member may be provided on the transfer vehicle that extends outward from the body (such as transverse or orthogonal to a plane passing through the magnetic or connection plate). The stabilizer element or plate may be planar in shape and include lock receiver surfaces or openings, and the vehicle receiver may include a receiving surface configured to mate with the stabilizer element and include a locking mechanism on this receiving surface that operates when actuated to extend into the lock receiver surface of the stabilizer element to further secure the transfer vehicle to the receiver (e.g., pins, rods (straight or tapered), hooks, latches, or the like that may be moved into contact with the stabilizer element or plate).

DETAILED DESCRIPTION OF THE PREFERRED EMBODIMENTS

Embodiments of the present invention are directed to a vehicle transfer system and to amusement park rides that use such a transfer system to transfer vehicles in a synchronized and seamless fashion into a moving train of vehicles. More specifically, embodiments of the invention provide a turntable system adjacent to the main ride track that can mechanically or via a control system synchronize with the movement of the train to transfer a vehicle onto or off of the main chain or train of vehicles that is being conveyed along by a drive or vehicle chain often with each vehicle supported on tracks or rails. The turntable system includes a turntable that rotates at a speed chosen based upon the speed of the vehicle train and includes a transfer vehicle (or vehicle body) that may be supported upon a transfer arm or extension of the turntable. The turntable is rotated such that the extension arm with the transfer vehicle comes into proximity or, in some cases, contact with a receiver in the vehicle train that is adapted for receiving and supporting in a fixed or secure way the transfer vehicle such as with mechanical latching, with magnets and mechanical interlocking, or the like. The turntable then continues to rotate to place the transfer arm out of the way of the next or neighboring vehicle in the train. In this manner, the amusement park ride can be operated in a desired, continuous manner while individuals with special loading and unloading needs can load and unload from transfer vehicles in the vehicle transfer system and its loading station.

Figure 1:
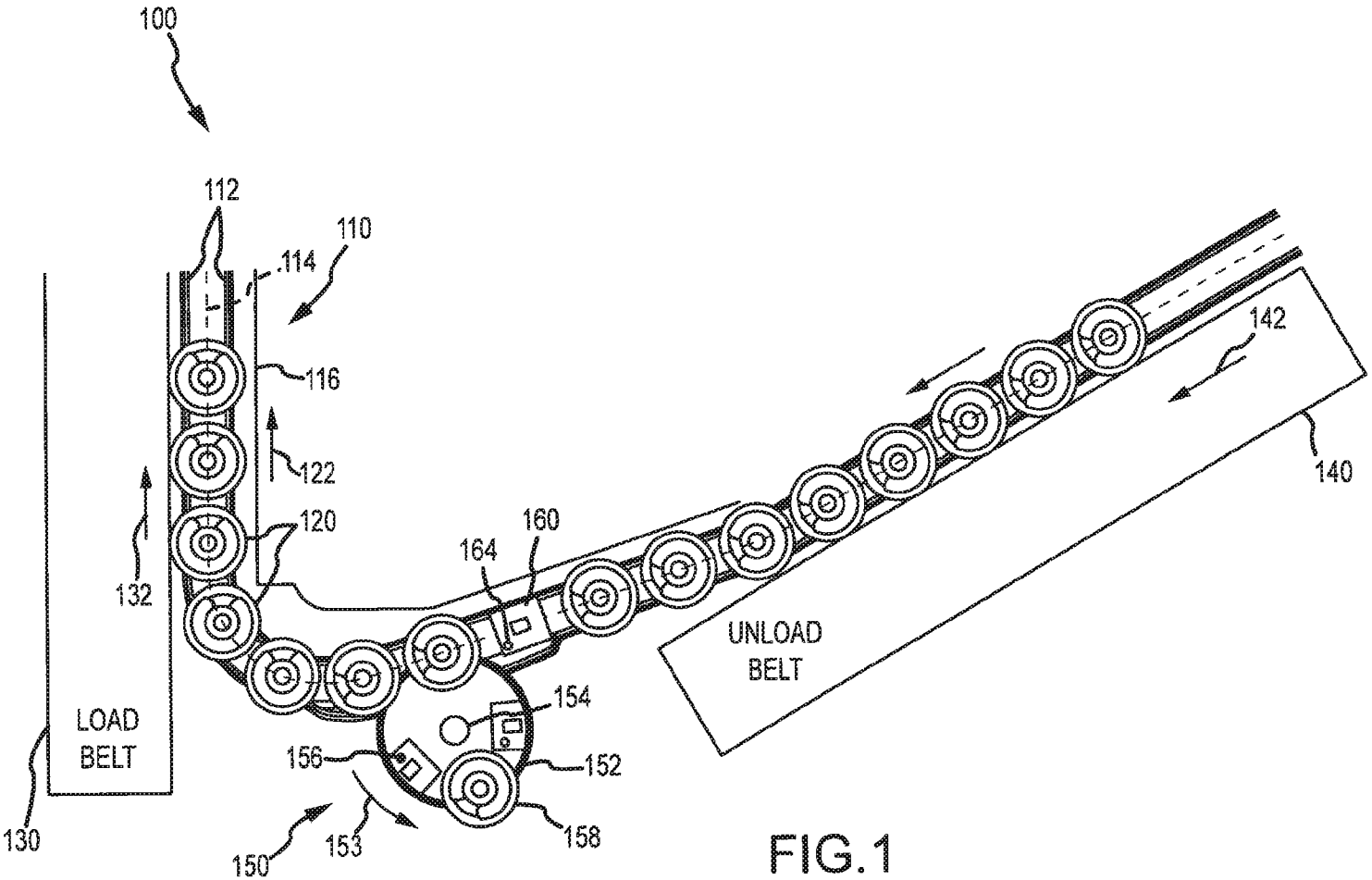
FIG. 1 is an overhead view of an omnimover-type amusement park ride in which a vehicle transfer table is provided to transfer vehicles to and from a moving train of vehicles without stopping a vehicle chain or drive chain.

FIG. 1 illustrates a partial view of a track and vehicle assembly or amusement park ride 100 of an embodiment of the invention. As shown, a track system 110 is provided that defines a course for a themed attraction such as a haunted house or the like and that includes a pair of rails/tracks 112 (with two rails/tracks shown in this embodiment but the invention may be used on a monorail-type ride as well as with track systems with more than two tracks/rails or even with "trackless" arrangement where other devices are used to define a course or path for the vehicles 120 and the concept of track or ride path is considered a broad term covering any such ride design). These tracks 112 may support, such as the wheels of, a number of vehicles 120 as they are conveyed along the track system 110 as shown with arrow 122 typically in an ongoing manner throughout the ride but at a relatively low speed such as to imitate a walking pace (e.g., up to 1 to 2 feet per second or the like). The track system 110 also includes floor 116 and a drive or vehicle chain 114 is provided under the floor 116 and each of the vehicles 120 is linked to the chain 114, which provides the motive force or drives the train of vehicles 120 along the rails 112. In other cases, the vehicles 120 may be connected to each other such as with tow bars and a subset of the vehicles 120 may be conveyed by the chain 114 with the others being pulled by their neighboring vehicles. In still other embodiments (not shown), the vehicles may be self-propelled (e.g., no drive chain provided) but still connected to adjacent cars in a train while other cases may involve independent operated self-propelled vehicles.

During normal operation, as discussed above, the vehicles 120 are not stopped for loading or unloading but continue at a particular ride speed 122 along the course defined by the rails/tracks 112. To provide loading and unloading, guests or passengers are conveyed along a load belt 130 that moves 132 at about the speed of the vehicles 120 and the passengers simply walk across the floor or platform 116 to get into an open vehicle 120. At the end of the ride, the guests or passengers being conveyed in vehicles 120 exit the slowly moving vehicles 120 step onto the floor or platform 116 and walk onto the unload belt 140 where they walk and/or are conveyed 142 out of the ride 100. This allows show portions of the ride to be timed to the continuously moving train of vehicles 120.

The ride 100 further includes a vehicle transfer system 150 that is adapted to allow guests or passengers with special loading/unloading needs to be able to load into a vehicle and unload from a vehicle at their own pace. In some operational modes, the loading and unloading is performed at an ongoing ride velocity without requiring the ride 100 to be stopped or even slowed, but in some embodiments, the ride velocity or speed may be varied to practice the invention. In other words, the ride may be slowed some percentage or amount during loading and unloading as described herein and then resumed afterward while in some rides the loading and unloading techniques may be used in rides in which the vehicle velocity is varied in differing parts of the track (i.e., the inventive techniques are well suited for use with omnimover-type rides but is not limited to such implementations).

In the exemplary but not limiting embodiment, the vehicle transfer system 150 is positioned between the load and unload stations or belts 130, 140 and guests with special loading/unloading needs such as handicapped or disabled individuals are directed to this loading station. As shown, the transfer system 150 includes a turntable 152 that rotates 153 about a central hub (or rotation axis) 154. The rotation 153 of the turntable 152 is synchronized (e.g., mechanically and/or via a control system as discussed below with reference to FIGS. 4-12) with the travel 122 of the train of vehicles 120. Synchronization of the travel of the turntable 152 and the vehicles 120 allows a transfer station/port 156 of the turntable to be aligned and/or mesh properly with a receiver vehicle 160 within the train.

As shown, a transfer vehicle 158 is provided at one of the transfer stations 156 and guests may be loaded into the vehicle 158 in this position of the turntable. When triggered in a synchronized manner, the turntable 152 rotates 153 such that the transfer vehicle 158 is positioned proximate to (or in the same location as) the receiver vehicle 160, which is attached to the vehicle or drive chain 114 to be conveyed with the other vehicles 120. The transfer vehicle 158 is then loaded onto the receiver vehicle 160 and captured (or safely secured) via a latching or connection mechanism 164 provided as part of the receiver vehicle 160. The turntable 152 then may continue to rotate such that there is no interfering components with the next approaching vehicle 120 and/or to place one or more of the transfer stations 156 in a desired location for later synchronization with vehicle 158 that is to be unloaded (e.g., with the reverse process as used for loading a vehicle onto the train of vehicles 120). The connection mechanism 164 may provide a mechanical component(s) for selectively capturing and releasing one or more components upon the bottom of the transfer vehicle or body 158. For example, the track and vehicle system 110 may take a form similar to that described in U.S. Pat. No. 3,554,130, which is incorporated herein in its entirety by reference, and the connection mechanism 164 would provide devices for connecting to linkages/rods extending outward from the bottom of the vehicles 158 (e.g., linkage/rod 25 and 117 shown in the incorporated patent and the body 158 may include stabilizing wheels and the like such as wheels 243 for mating with a track, rail, or guide).

In other cases, such as those shown in FIGS. 4-12, selective operation of magnets may be used to provide the connection mechanism 164 on receiver 160. In some cases (not shown), a transfer vehicle previously inserted into the train may be replaced or exchanged with one on the transfer turntable using mechanical techniques such as those used in figure 8-type rides where one vehicle is moved from one loop to another of a figure 8 ride course. The specific device used for selectively engaging the transfer vehicle 158 is not limiting of the invention with the important aspect being that once engaged, the turntable 152 is synchronized with the moving chain 114 and an offline (and typically loaded) vehicle 158 can be transferred into an online and moving receiver 160 (and then later unloaded in a similar manner with selective engagement provided by the transfer station assembly 156 and the receiver/connection mechanism 164).

Figure 2:
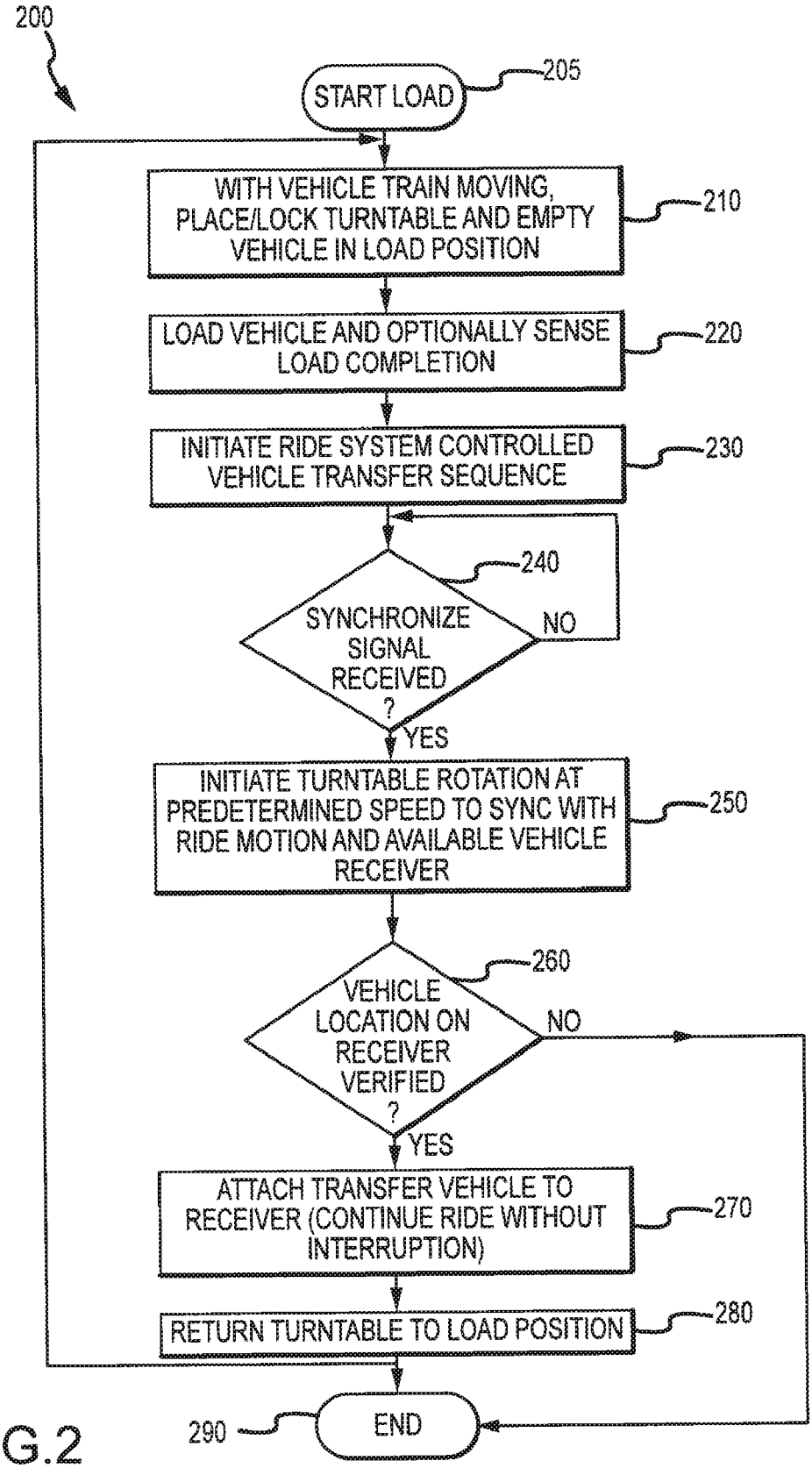
FIGS. 2 and 3 illustrate flow charts of loading and unloading processes that may be carried out during operation of rides adapted according to the present invention such as the system shown in FIG. 1.

FIG. 2 illustrates a loading (or transfer in) process 200 of an embodiment of the invention such as may be used to transfer a vehicle 158 into a train of vehicles 120 during operation of the ride 100 of FIG. 1 (or during operation of the ride or system 400 shown in FIGS. 4-12). As shown, the loading process 200 starts at 205, and this may include providing a vehicle transfer system adjacent an omnimover or other synchronous operations ride track. At 205, the vehicle transfer system may be initiated or started up with necessary sensors or mechanical meshing/synching devices positioned in locations along the ride track to facilitate detection or sensing of the location of an empty or available receiver. At 210, the method 200 continues with the ride being operated to move a train of conventional vehicles along a track such as by moving a hidden drive or vehicle chain. Within this chain, as discussed above, at least one receiver is provided that is configured for receiving a transfer vehicle. Also at 210, the method 200 includes placing or locking the turntable and at least one empty vehicle in a load position. For example, an empty transfer vehicle may be physically supported upon or by the turntable (e.g., upon or by a transfer or extension arm) and the transfer vehicle may be positioned adjacent a passenger loading platform (e.g. a handicap-accessible ramp or the like leading up to the transfer vehicle).

At 220, the vehicle is loaded such as with 1, 2, or more guests typically including at least one guest that requires assistance in loading the vehicle or that requires assistance in placing a wheelchair within the vehicle (or getting out of their wheelchair and into the vehicle seats). At 220, the completion of loading may also be sensed with sensors such as by closing a mechanical connector, lowering a guard rail/arm to a loaded/closed position, clasping a seat belt or strap, or the like. At 230, an operator of the vehicle transfer system may operate a control system to initiate a ride system-controlled vehicle transfer sequence. In some embodiments, the transfer sequence is automated from this point on (except for manual/emergency override controls) with a ride control system acting to complete transfer of the vehicle into the moving vehicle train.

At 240, the control system and transfer system are "armed" and wait for and detect when a synchronization signal is received indicating that an available receiver is approaching the transfer system and its turntable (e.g., a receiver is in a first synchronization location along the track). If not, the method 200 continues at 240 awaiting this receiver detection signal. After receiving and processing a detection or synchronization signal, the ride control system acts to initiate rotation of the turntable at a predetermined speed or rate of rotation to synchronize the turntable movement with the vehicle movement and, more importantly, to place the transfer vehicle loaded with guests in contact with or in proximity with the approaching available receiver.

At 260, the control system may also act to sense when the transfer vehicle is physically located adjacent or on the receiver, and, when the presence and location of the transfer vehicle relative to the receiver is detected/verified the transfer vehicle is attached at 270 to the receiver and the train of vehicles continues to be conveyed along the track without slowing or interruption. The attachment may be purely mechanical with no additional controls or actuation required from the control system or even in the mechanical situation it may be useful to actuate a locking mechanism to securely affix the received vehicle to the receiver or its platform. In other cases, the attachment may be performed under the direction of the control system such as when magnetic forces are used such as to activate an electromagnet on the receiver to attract or capture the transfer vehicle and to deactivate an electromagnet on the turntable to release the vehicle. Locking mechanisms such as clasps or pins may also be moved (such as by electric motors, hydraulic systems, or the like) to mechanically secure the transfer vehicle to the receiver (e.g. to provide a backup or secondary attachment to enhance safety and reduce risks associated with a power loss or other operating condition). At 280, the vehicle transfer system may continue to rotate the turntable so as to place it into an additional load position (e.g., such as when the turntable includes more than one load and unload station with two or more transfer arms/extensions) or to move the transfer arm/extension that had been holding the now-transferred vehicle away from the vehicle train to avoid contact with other vehicles in the train. The method 200 may end at 290 (such as by waiting for a vehicle to unload) or may continue back to step 210 with a next transfer vehicle placed in a loading position. If at 260, the vehicle is not verified in location on receiver, a failure or override mode may be entered with the process ending at 290. Timing and proper synchronization is very important and when the transfer table and transfer vehicle are not synchronized in time/location the ride typically will be stopped to allow a manual override process to be initiated to properly position the transfer vehicle upon the receiver or to otherwise address the failure.

Figure 3:
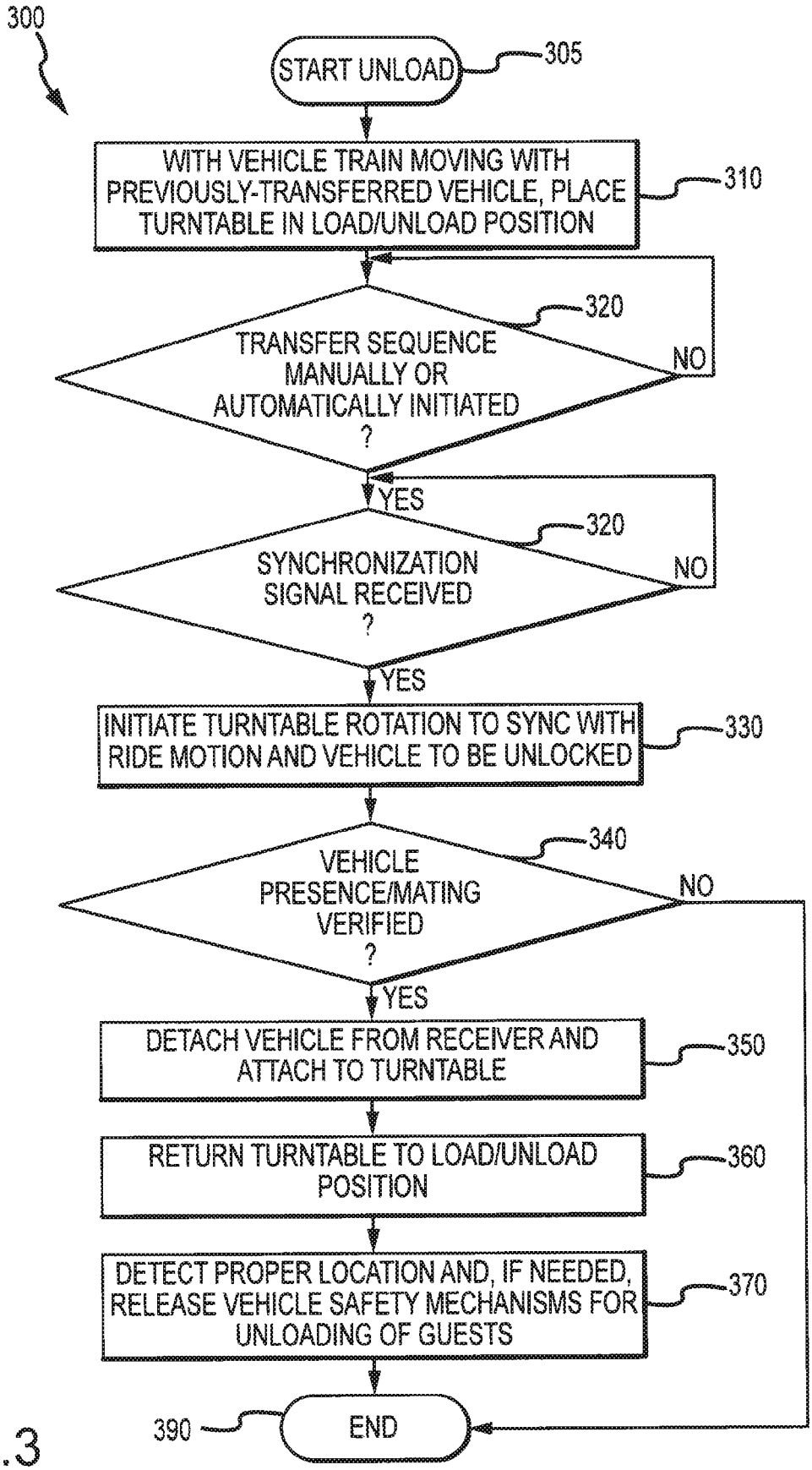

FIG. 3 illustrates an unloading process 300 that starts at 305 such as with the completion of the loading process 200 and control being turned over to an unloading module or portion of the ride control system. At 310, the method 300 continues with the vehicle train moving with a previously-transferred vehicle in the train. The transfer turntable is locked such as with the extension or transfer arm away from the path of the train/ride, e.g., back into a load position but with no vehicle the transfer arm. At 320, the transfer sequence is manually or automatically initiated by an operator or by the ride control system. The vehicle transfer system is "armed" and awaits at 320 the receipt of a synchronization signal such as a sensor(s) detecting a particular position along the ride course or track of an approaching receiver that has an attached/loaded vehicle. When detected (or after an appropriate delay to assure synchronization), at 330, the ride control system acts to initiate turntable rotation (e.g., operating of an electrical motor or other drive system used to rotate the turntable) to synchronize the ride motion or speed and rotation of the turntable so as to place an empty transfer arm/extension of the turntable adjacent or in contact with the loaded receiver.

At 340, the presence of the loaded vehicle in contact with or in appropriate proximity (or relative location) with the transfer arm is detected and the ride control system acts to initiate release of the vehicle from the receiver and capture or connection to the turntable at the transfer arm or extension. In some embodiments, steps 340 and 350 are handled without initiation by the control system such as by use of purely mechanical latches and releases while, as discussed above for loading 200, control signals may be used to cause the transfer arm to capture the vehicle (such as by activating an electromagnet(s) and/or mechanically connecting to the vehicle) and the receiver to release the vehicle (such as by retracting any mechanical connecting mechanisms such as pins, clasps, hooks, and the like and/or deactivating an electromagnet(s)). At 360, the turntable is rotated until the vehicle is in an unload position, e.g., adjacent a handicapped-accessible ramp, and at 370, the proper location is detected and, if needed, safety mechanisms are released or deactivated (such as belts, passenger restraints, and the like) to allow the guests to unload or exit the vehicle. The unloading 300 ends at 390 or continues at 310 with awaiting for another vehicle to unload (or with loading 200 as shown in FIG. 2 with new guests entering the unloaded/empty vehicle on the turntable). Again, at 340, if proper synchronization between the turntable and transfer vehicle is not sensed/detected, a failure mode may be initiated that either aborts transfer and continues the ride without unloading the vehicle or acts to stop the ride to allow an operator to correct an improper synchronization issue.

With the ideas presented in FIG. 1-3 in mind, it may now be useful to discuss in more detail the components and operation of one exemplary vehicle transfer system that uses magnetic forces to transfer vehicles into and out of a moving vehicle train. One such exemplary vehicle transfer system 460 is illustrated as it may be utilized in a ride 400 in FIGS. 4-12. As shown, the ride 400 includes a track system 410 with a guide track 412 (or pair of rails) that defines a course along which a plurality of vehicles 411 is conveyed as shown with arrow 418. The track system 410 further includes a platform or floor 414 over which the vehicles 411 travel and that allows guests/passengers to safely enter and exit the vehicles 411. A slot or seam 416 is provided through which a link (not shown) to a drive or vehicle chain positioned below the platform 414 may be provided to one or more of the vehicles 411. As discussed above, the vehicles 411 are typically moved in a continuous manner throughout a ride and even during loading and unloading at a constant speed (e.g., about 1.5 ft/second). Each of the vehicles 411 includes a base or chassis 422 that is connected to the vehicle chain with wheels 424 that ride on the guide track 412 and also include a body 426 with seating for 1, 2, or more guests. In this example, the vehicles 411 are linked together with tow bars 428, but this is not required if each vehicle 411 is individually connected to a common drive chain (as is often the case for synchronous rides such as omnimover rides).

Significantly, the ride 400 includes a vehicle transfer assembly 460 that is generally made up of a transfer vehicle receiver 430, a transfer table 470, a transfer vehicle 480, and a loading/operator platform 462. The vehicle receiver 430 is positioned within the train of vehicles 411 to move 418 along with these vehicles 411 (such as with a connection to the drive chain (not shown) or to other vehicles 411 via tow bars 428). The receiver 430 includes a base or chassis 432 with wheels 434 for contacting the track 412. The receiver 430 also includes a receiving surface 436 that is recessed from the main, upper surface of the chassis 432 and arcuate sidewall 438 extending up from this receiving surface 436. These components of the receiver 430 enable or facilitate mating with the transfer vehicle 480 while other components provide functionality to selectively capture and release the vehicle 480. To this end, the receiver 430 includes an electromagnet 440 mounted on the sidewall 438 that can be selectively activated/powered so as to attract portions of the transfer vehicle 480 such as a magnet or magnet plate 484 (or a portion of the vehicle/body 480 that is metallic) on the vehicle. The magnet 440 may also be provided on the receiving surface 436 and/or two or more magnets may be utilized with only one shown for ease of explanation but not as a limitation. Sensors 444, 446 (such as optical sensors) may be provided on the receiver 430 to sense when the vehicle 480 is in proper position or alignment with the receiver 430 (and/or sensors may be provided upon the vehicle 480). A signal from these sensors 444, 446 may be transmitted to a control system (with a control panel/console 464 shown in the figures) that responds by operating the electromagnet 440 (e.g., to power it during loading/transfer into train and to de-energize the magnet 440 during unloading/transfer out of the train). To provide a secondary connection (or in some cases primary connection in place of the magnet), the receiving surface 436 may include connection mechanisms 454 in the form stabilizer or locking pins that can be actuated to extend upward a distance from the receiving surface 436 (e.g., into holes 608 in a stabilizing or attachment platform 482 shown in FIG. 6 (or tongue or insertion member for a tongue and groove-type connection)), with this connection mechanism or locking pins 454 being actuated by the control system upon receiving a signal from the sensors 444, 446 verifying proper positioning of the vehicle 480 on the receiving surface 436.

Figure 7:
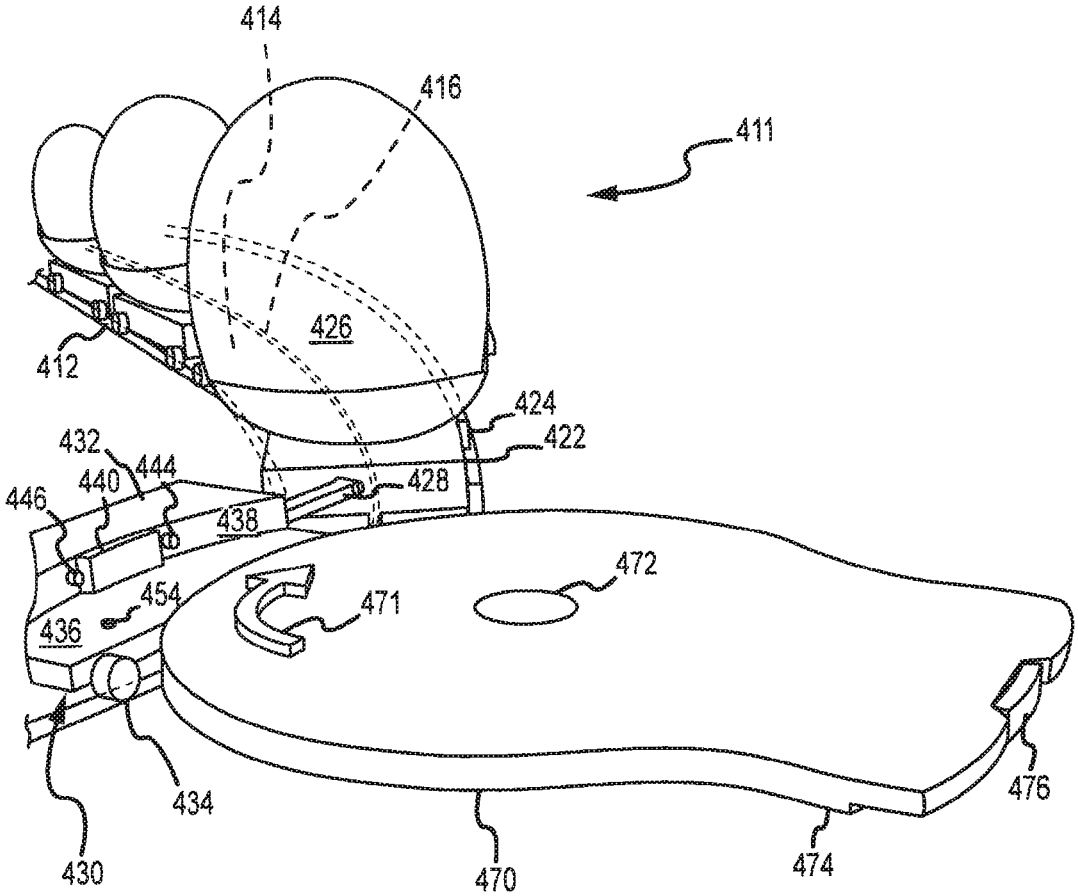
Figure 8:
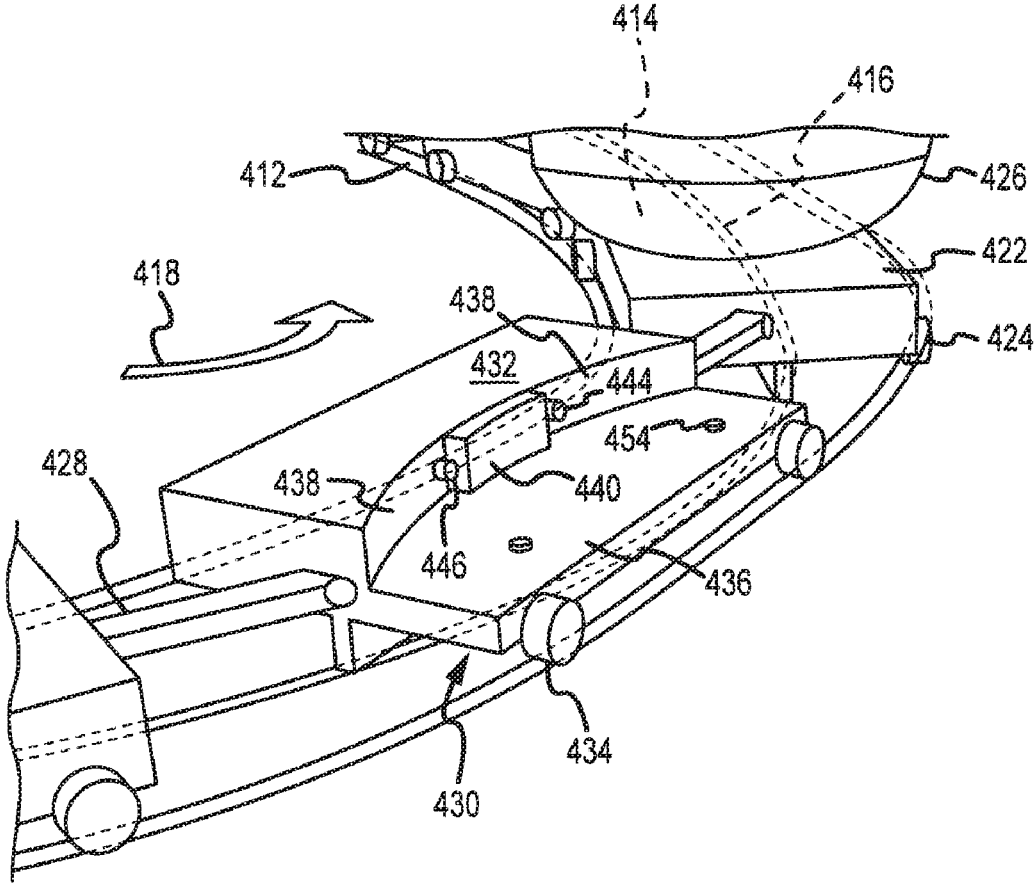

The vehicle transfer system 460 also includes a transfer turntable 470 that can be selectively rotated such as in response to actuation or control signals from a ride control system as shown at 471. The turntable 470 rotates about a central hub 472 at a speed or rotation rate chosen to position a transfer arm or extension 474 over or adjacent the receiving surface 436 of the receiver 430. An electric motor or other drive device (not shown) may be operated by the ride control system to provide this desired rotation 471 of the turntable 470 about the hub 472. As can be seen in FIG. 7, the turntable 470 is generally circular in shape but includes the transfer arm 474 that increases the diameter of the table 470 (such as by several feet) such that the turntable 470 is spaced apart (out of the travel path) from the train of vehicle 411 when it is in the passenger load/unload position shown. In contrast, the turntable 470 or at least the transfer arm 474 is placed into the path of travel of the vehicle 411 when in the vehicle transfer/exchange position shown in FIG. 9 (e.g., with the transfer arm 474 over or adjacent the receiving surface 436). The transfer arm 474 further includes a slot or recess for receiving the stabilizing or mating platform 482 of the transfer vehicle 480. More importantly, the table 470 is configured with a connection mechanism in the form of an electromagnet 476 along an exposed surface or side of the transfer/extension arm 474. This electromagnet 476 can be selectively energized to connect with and support transfer vehicle 480 and to release the vehicle 480 upon operation of the ride control system (or a control system provided for transfer system 460). Specifically, the magnet 476 may use electromagnet forces to capture a magnetic plate 484 upon the vehicle 480 or to a metallic portion of the base of the vehicle 480. The size and shape of the magnet 476 is generally selected to match the plate 484, and, more significantly, the power or strength of the electromagnet 476 is chosen so as to allow the magnet 476 to hold or support the weight of the vehicle 480 along with a factor of safety (such as 1.5 to 3 times the weight of the vehicle 480).

Figure 4:
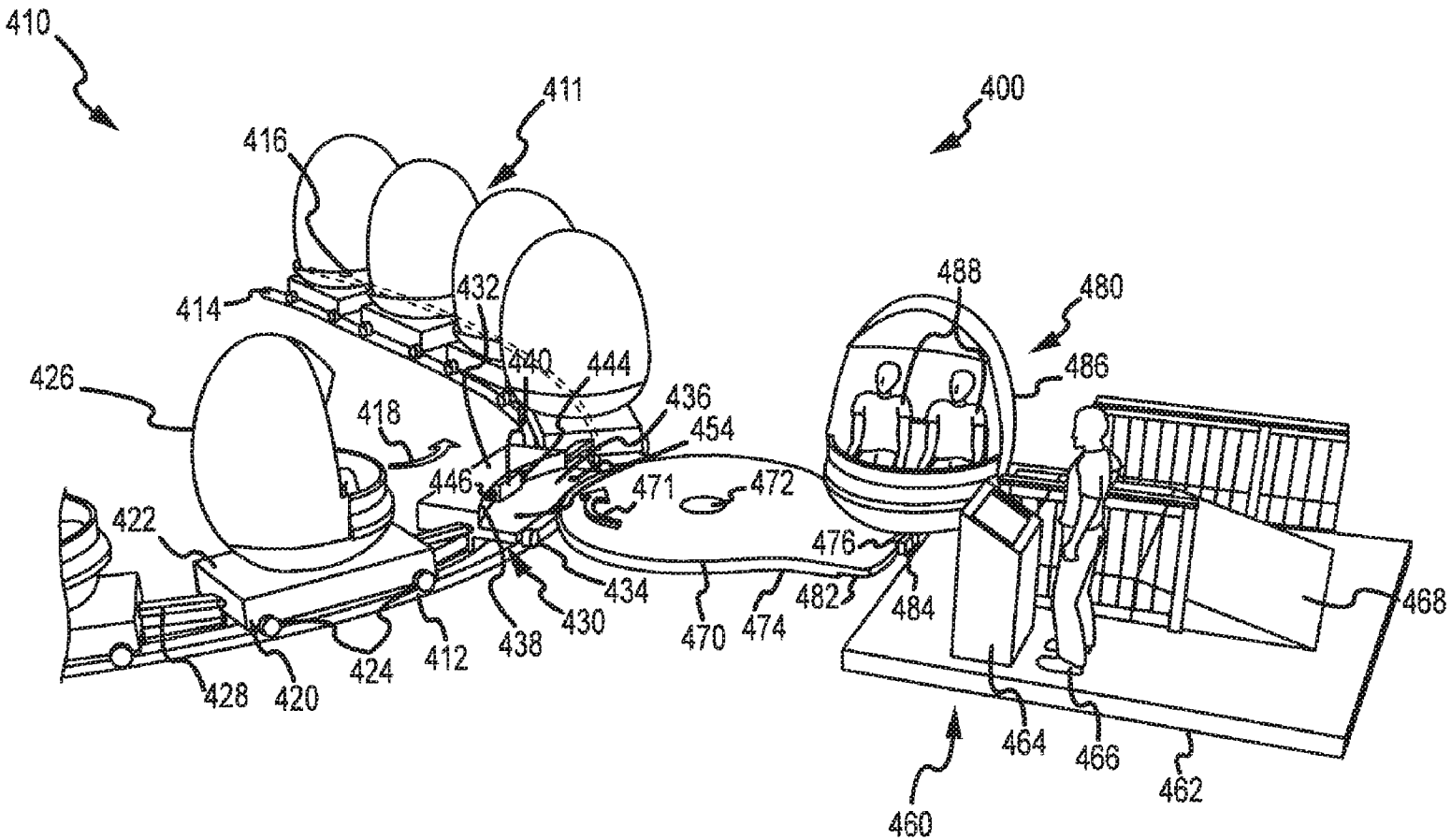
FIGS. 4-12 illustrate various views of an amusement park ride according to an embodiment of the invention providing a turntable-based vehicle transfer assembly that uses electromagnets for selectively attaching and detaching transfer vehicles to a turntable and to a vehicle receiver moving within a train of vehicles.
Figure 5:
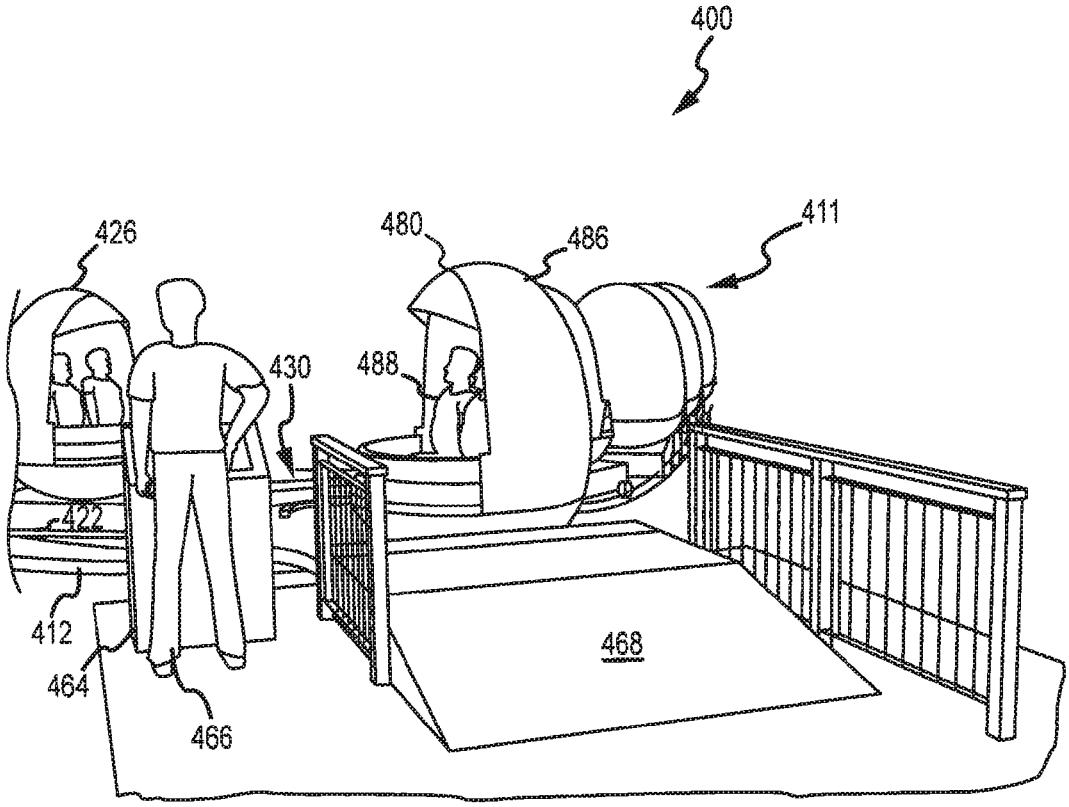
Figure 9:
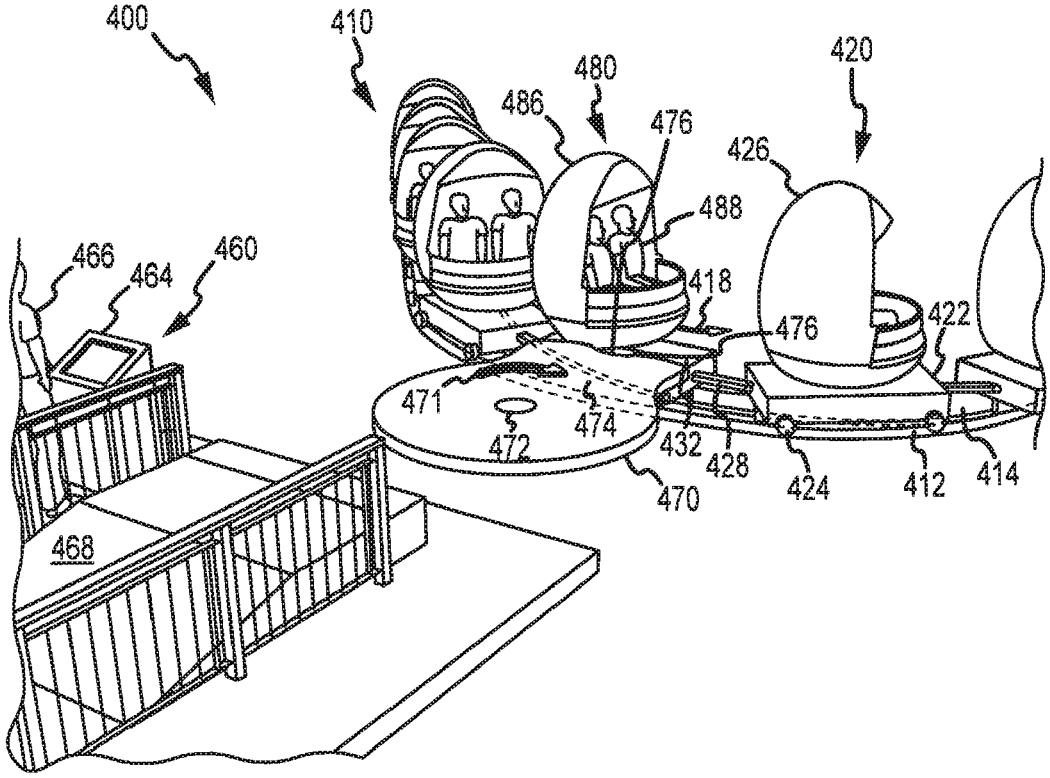
Figure 10:
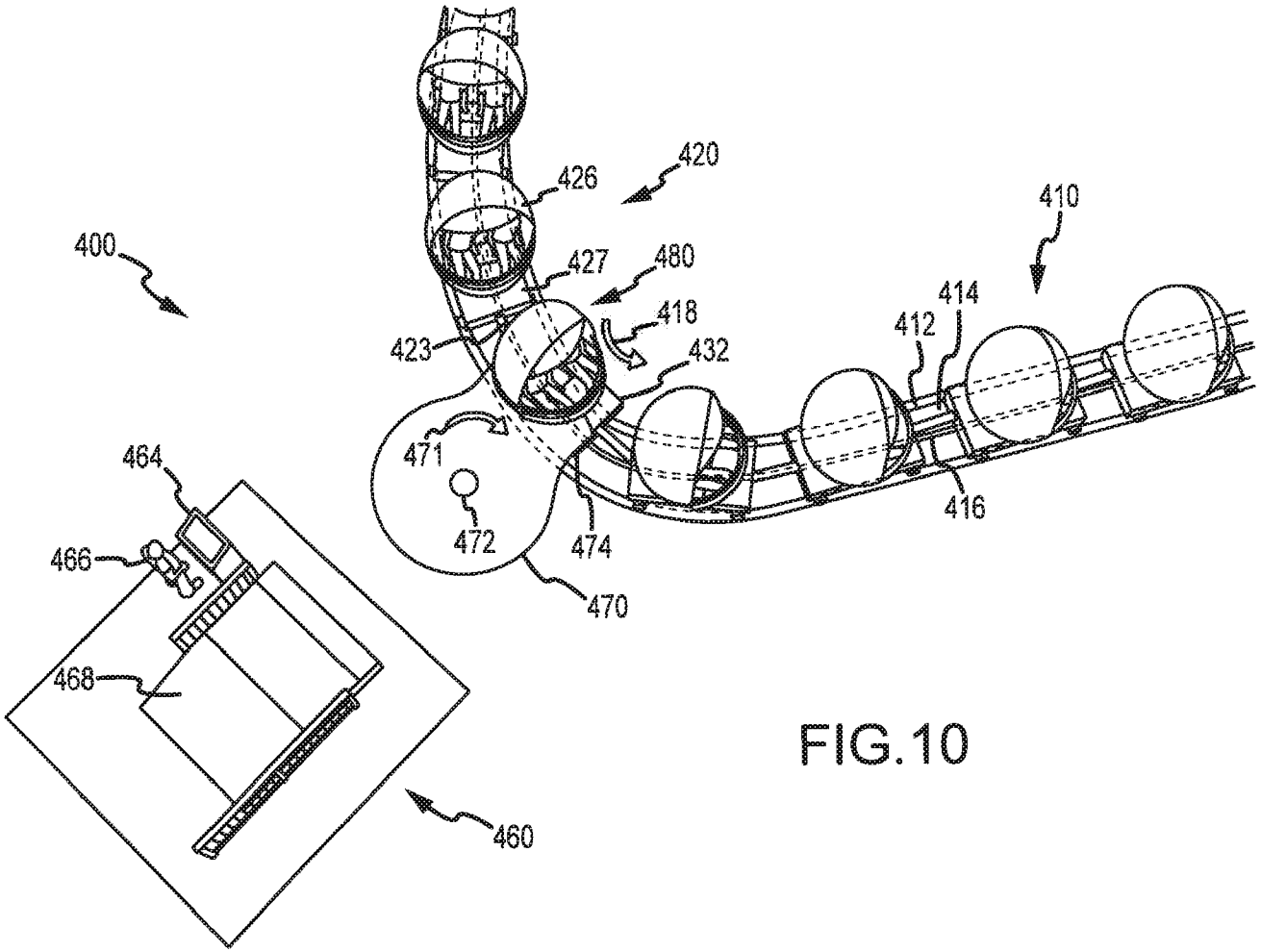

The vehicle transfer assembly 460 also includes one or more transfer vehicles 480. FIGS. 4 and 5 illustrate the vehicle 480 in a load/unload position in which it is attached to or captured and supported by the turntable 470 and located adjacent the loading platform 462 to allow passengers to enter and exit the vehicle 480. FIGS. 9 and 10 illustrate the turntable 470 and vehicle 480 in transfer positions with the turntable transfer arm 474 on or adjacent the receiver 430 and the transfer vehicle 480 also positioned on or adjacent the receiver 430 where the receiver 430 (or its connection mechanism components 440 and 454) may be selectively operated to capture the vehicle 480 and to release the vehicle 480.

Figure 6:
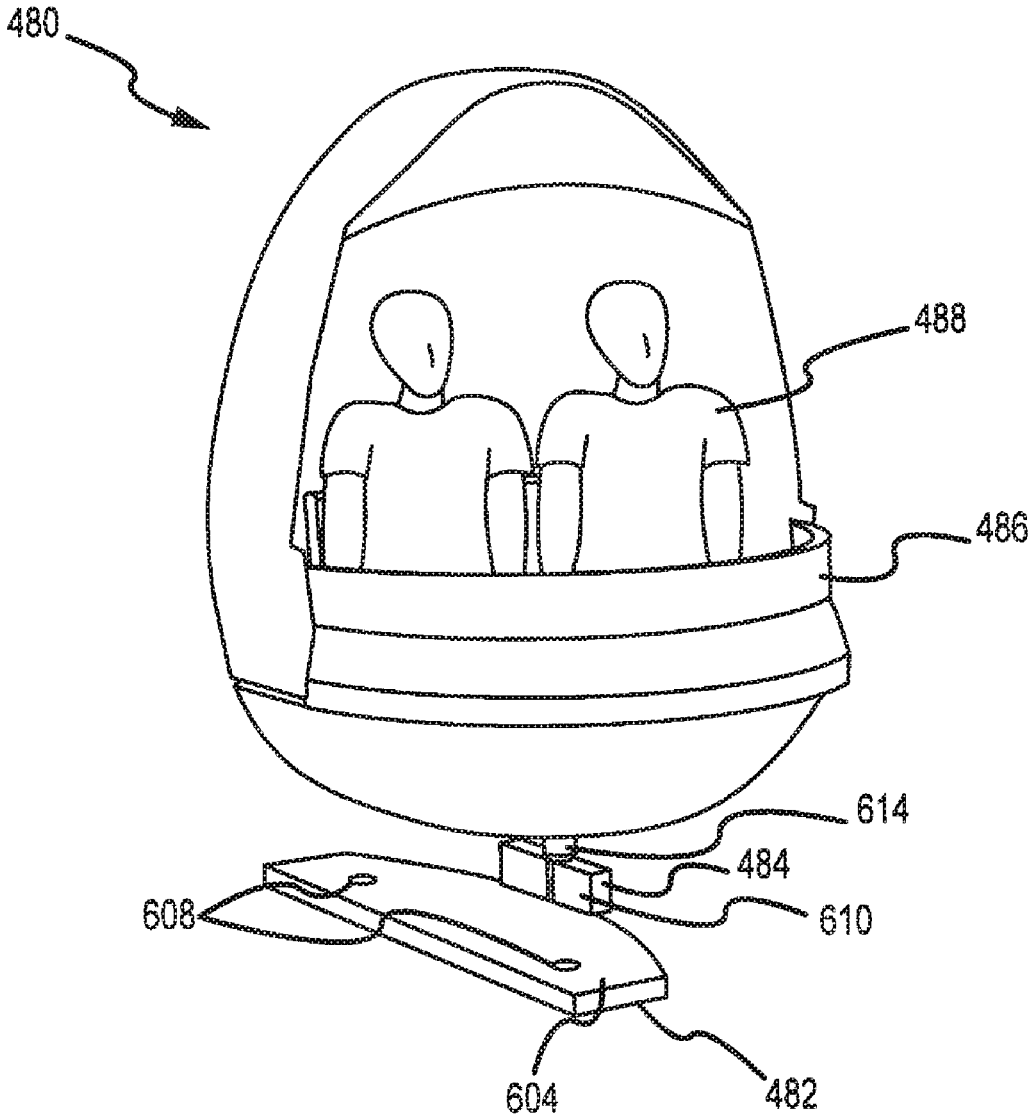

FIG. 6 illustrates the vehicle 480 in more detail. As shown the vehicle 480 includes a vehicle body 486 with a housing or interior space with seating for one or more passengers 488, and the body 486 may be specially adapted for receiving handicapped passengers and, in some cases, their wheelchairs and/or walking aids. At the base of the body 486, the vehicle 480 includes a magnetic plate 484, which may be an elongate plate of a variety of shapes and sizes and may be formed of steel or other material that is attracted to an electromagnetic. In one embodiment, the magnetic plate 484 is formed of a steel plate while in other embodiments the magnetic plate 484 is formed of a permanent magnet material(s). As illustrated, the magnetic plate is a rectangular plate about 1 to 2 feet in length, about 4 to 10 inches in width, and 0.5 to 3 inches in thickness, but other shapes and sizes may be used such as square plates, circular plates, and the like.

The magnetic plate 484 extends outward from the base of the body 486 and is attached to the body 486 via post 614 with a first attraction or mating surface 610 facing or adjacent a stabilizer, locking, and/or mating member or platform 482, which typically is rigidly attached to the base of the vehicle 486 by attachment to the post 610 and/or to the plate 484. The first attraction or mating surface 610 is used to mate with the electromagnet 476 of the turntable 470 in the load/unload position while a second attraction or mating surface opposite the first surface 610 is used to mate with the electromagnet 440 on the receiver 430. The stabilizer member 482 is a substantially planar member that is shown to extend outward from the base of the body 486 transverse to an axis of the post 614 (or a plane of the plate 484) and, in some cases, the member 482 is substantially orthogonal to the post 614 and plate 484 although this is not required in all embodiments. The stabilizer member 482 includes an upper mating surface 604 with holes or openings 608 to provide locking areas on the surface 604 for receiving or mating with locking pins/connectors 454 on the receiver 430 (and/or on the turntable 470 in the transfer arm 474, not shown). The member 482 typically only extends outward from the first surface 610 but may extend outward from both sides or surfaces of the magnetic plate 484. The member 482 is sized and shaped to fit into or onto the receiving surface 436 of the receiver vehicle 430 and into the recessed portion of the transfer arm 474 of the turntable 470. Again, numerous shapes and sizes may be used for the member 482 to provide receiving openings or connection surfaces 608 for facilitating selective connection (or capture/release) of the vehicle 480 by the receiver vehicle 430.

The assembly 460 further includes a loading/unloading platform 462 that may be positioned near other loading and unloading stations/platforms for the track and vehicle system 410, such as between the loading and unloading belts shown in FIG. 1. The platform 462 is positioned proximate to and/or adjacent the turntable 470 such that a vehicle 480 captured/supported by the transfer arm 474 may be positioned next to a loading ramp 468. The ramp 468 is shown to be wheelchair accessible and in some cases, the vehicle 480 may be adapted to contain one or more wheelchairs while in other embodiments the passengers 488 will be moved out of their wheelchairs and into the vehicle 480.

On the loading platform 462, a transfer operation console 464 is provided that may be operated by a ride operator 466. The console 464 is configured to provide an interface with a ride control system (not shown) for the ride 400, such as may operate as discussed with reference to the load and unload processes 200 and 300 shown in FIGS. 2 and 3, respectively. For example, the console 464 may allow the operator 466 view a GUI or other user interface that displays sensed operating conditions such that the table 470 is locked in a load/unload position (e.g., the turntable 470 is positioned as shown in FIG. 4 and the electromagnet 474 is operating) at which time the operator 466 can assist passenger 488 in and out of the vehicle 480. The console 464 may also be used to allow the operator 466 to initiate vehicle transfer operations to transfer the loaded vehicle 480 from the turntable 470 to the receiver 430 such as by transmitting a signal to the ride control system to determine a location of the receiver on the track 412 and to initiate rotation 471 of the turntable 470 to achieve synchronization or co-location of the transfer arm 474 and the receiver 430 at a transfer position. The console 464 may also be used/operated by the ride system to display other sensed or detected information such as proper capture of the vehicle 480 by the receiver 430 and positioning of the turntable 470 back into the load/unload position. In some cases, the operator 466 may initiate transfer of a vehicle 480 off of the receiver 430 while in other cases this is an automated feature of the ride control system (or its software programs) to detect when a loaded receiver 430 is approaching the platform 462 and to initiate rotation of the turntable 470 to properly align the empty or available transfer arm 474 with the vehicle-laden receiver 430 to facilitate unloading (as shown in process 300 of FIG. 3).

At this time, it may be useful to describe typical operations of the ride 400 to load/unload the vehicle 480 and to transfer the vehicle 480 to and from the receiver 430 with the electromagnets 440 and 476 along with locking devices/pins 454 being used to provide nearly instantaneous actuation (release and capture) to provide a more than adequate securing and/or holding force. As shown in FIG. 4, the turntable 470 with a captured or connected transfer vehicle 480 on the transfer arm 474 is positioned and locked in a load/unload position. The vehicle 480 is then determined to be ready for transfer into the vehicle train moving on the track system 410 such as by determining the guest(s) 488 are seated and properly restrained by manual processes and/or automated processes (e.g., detection that a restraint is properly latched/locked and/or positioned). The operator may then interact with the operation console 464 to initiate a ride system-controlled transfer sequence. At this point, the ride system may arm the transfer system 460 and wait for a synchronization signal (e.g., a signal that an available vehicle receiver 430 is at a particular location upstream or away from the turntable 470). The ride control system processes such signal and at an appropriate time initiates rotation 471 of the turntable 470 about the hub 472 at a rotation rate that is predetermined to be correct to achieve proper synchronization of the turntable 470 and the receiver 430.

Figure 11:
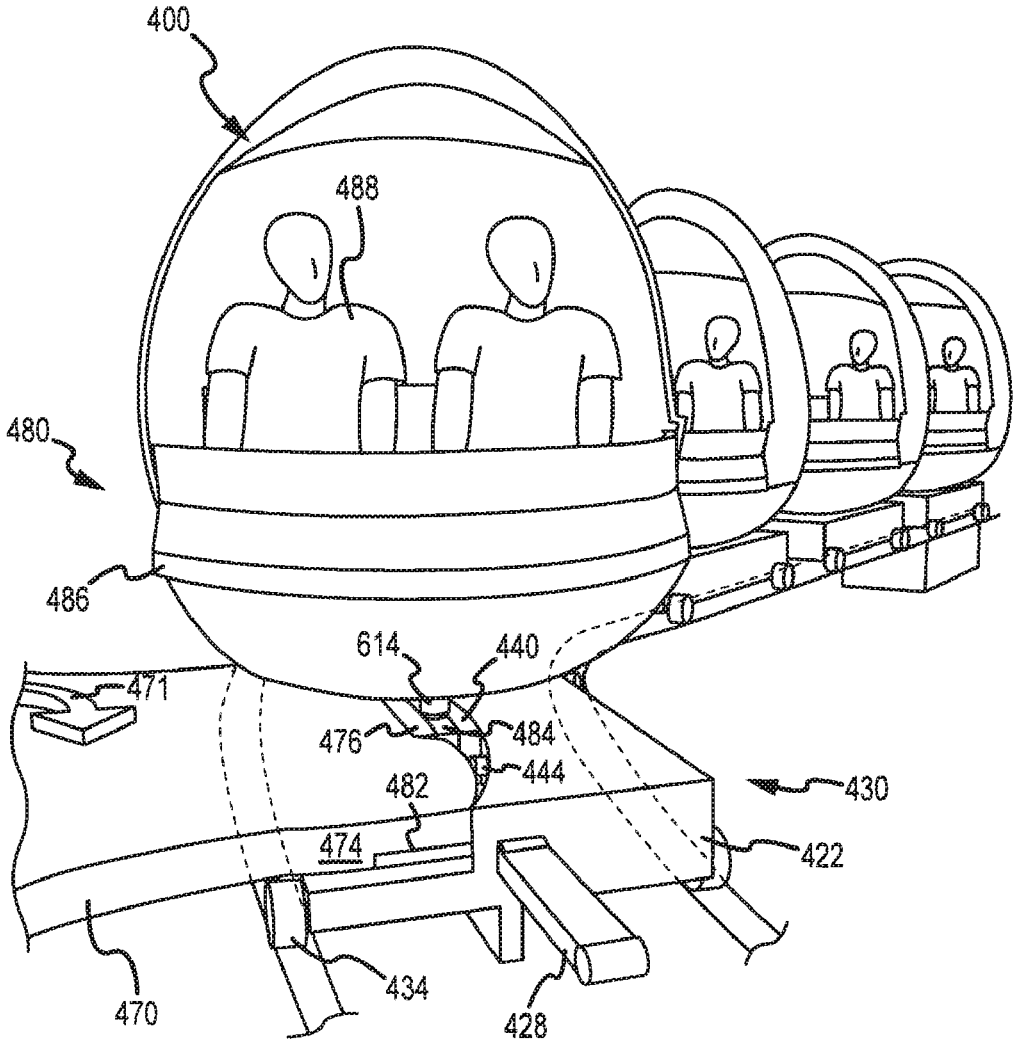
Figure 12:
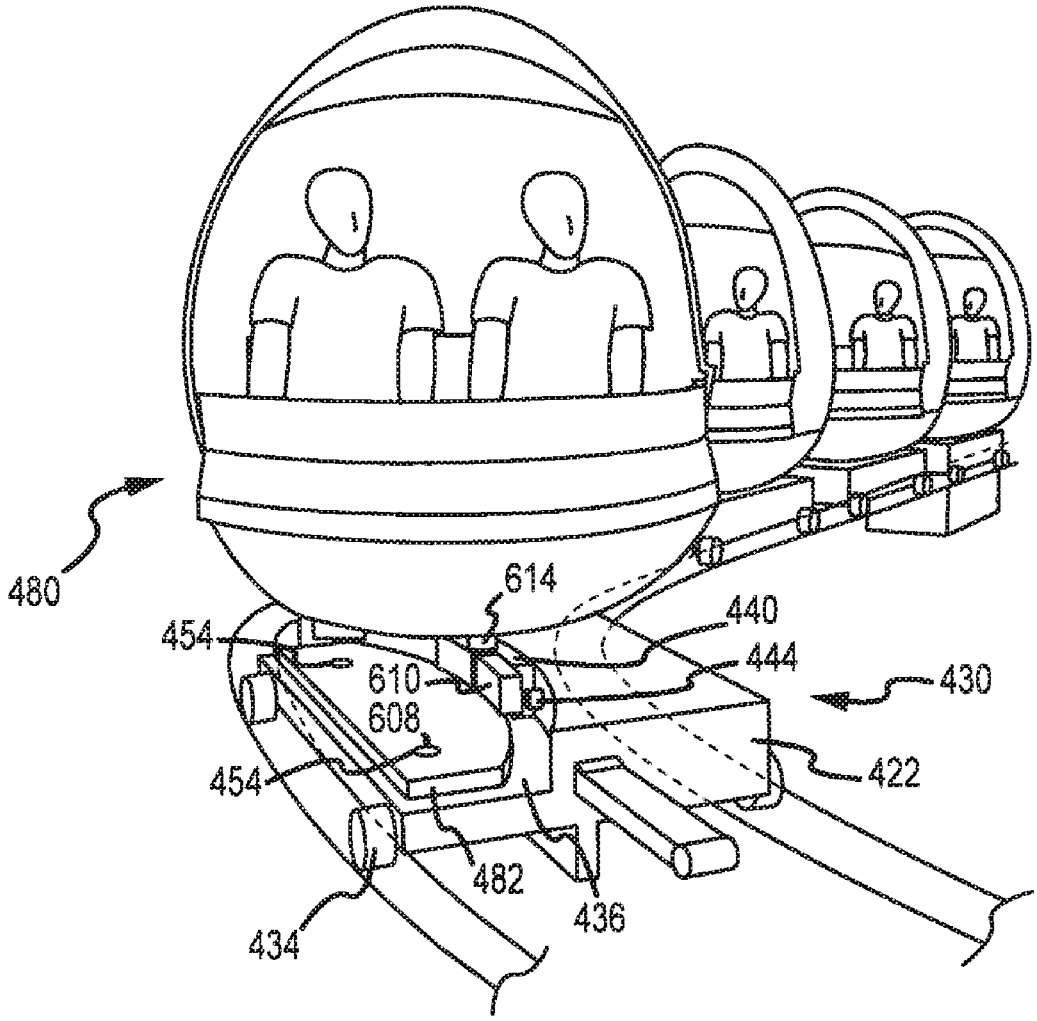

The turntable 470 continues to rotate 471 and meshes with the available transfer receiver 430 as shown in FIGS. 9-11. The sensors 444 and 446 may transmit a signal to the ride control system to indicate the presence and proper location of the vehicle 480 adjacent the receiver chassis 432 and receiving surface 436. At this point, the ride control system acts to turn on or power the receiver electromagnet 440 and actuate the locking pins (or other mechanisms) 454 to capture or connect the vehicle 480 to the receiver 430. The control system then turns off (de-energizes) and/or disengages the electromagnet 476 of the transfer arm 474 (and any provided locking/connection mechanisms) to release the vehicle 480 from the turntable 470. With transfer complete, the ride 400 continues to move the train of vehicles 411 with the transfer vehicle 480 on the receiver 430 along the track/rail 412. The turntable 470 continues to rotate 471 until it is back in a load/unload position with the transfer arm 474 out of the path of oncoming vehicles 411. Sensors may be provided on the loading platform 462 to sense when the transfer arm is back into the load/unload position and then the ride control system may stop rotation and lock the turntable 470 into the load/unload position.

The unload sequence may then proceed with an operator 466 initiating a transfer sequence or the ride control system may detect a loaded vehicle 480 on a receiver 430 approaching the platform 462. In either case, the system 460 may be armed and wait for a synchronization signal from one or more optical or other sensors on the track system 410 (not shown). Once a position of a loaded receiver 430 is detected, the ride control system operates to initiate rotation 471 of the turntable 470 at a proper time to synchronize the rotation 471 with the ride speed/motion 418 to align the empty/available transfer arm with the loaded receiver 430 to achieve proper meshing (e.g., positioning in proper alignment and proximity to allow a handoff of the vehicle 480 between the receiver 430 and the transfer arm 474). Sensors in the receiver 430 and/or in or on the turntable 470 (not shown) may be used to detect when the turntable transfer arm 474 and receiver 430 are both present and aligned/positioned in a transfer position. At this point, the ride control system may operate to turn on or power/engage the electromagnet 476 to apply capturing electromagnetic forces to the magnetic plate 484 (e.g., the first surface 610 of the plate 484). The ride control system may also turn off or de-energize the electromagnet 440 on the receiver 430 as well as the locking/connection mechanisms or pins 454 to release the vehicle 480 from the receiver 430. With the hand off or transfer complete, the ride 400 continues operation uninterrupted with the now empty or unloaded receiver 430 moving with the other vehicles 411 along the track 412. The turntable 470 continues to rotate 471 so as to position the transfer arm 474 and vehicle 480 into the load/unload position as shown in FIG. 4. This position may be verified with one or more sensors, and when verified, the ride control system may act to lock the turntable 470, and the operator 466 may then assist the passengers 488 out of the vehicle body 486 and down the ramp 468.

Although the invention has been described and illustrated with a certain degree of particularity, it is understood that the present disclosure has been made only by way of example, and that numerous changes in the combination and arrangement of parts can be resorted to by those skilled in the art. For example, the embodiments of FIGS. 4-12 illustrate the use of magnetic components to facilitate exchanging vehicles between a moving receiver and a rotating turntable with its transfer arm or extension. In other embodiments, mechanical synchronization may be used between the turntable or transfer system and the ride system to provide transfer of a vehicle onto and off of the main chain towing a set of vehicles. In one case this is achieved with a vehicle transfer system that is adapted to work similar to figure 8-type ride systems that presently are in use to exchange vehicles mechanically from one loop of a ride to another adjacent loop (e.g., one portion of the FIG. 8 to another portion or loop) such as the Lady Bug Boogie ride at Disney's California Adventure or Cars ride at Disneyland Studios Paris, both operated by Disney, Inc. that operated to transfer a guest pod or vehicle onto a moving receiver or bogie. Since such a vehicle transfer system provided adjacent the main track can be mechanically synchronized (in this embodiment) and operated to match its speed with its turntable rotation, the main ride system does not have to be stopped although actuation may be required by an operator (e.g., to extend a synch arm toward the track that may be contacted by a trigger element on the chain to indicated the presence of an open location for receiving an additional (loaded) vehicle that causes the turntable to rotate with the main vehicle chain or the like).

In the transfer assemblies described, effective transfer relies upon a vehicle being at a specific location or space at a particular time that is synchronized either with receiver on the ride course or "track" during loading or with receiver on a turntable during unloading. The systems illustrated have generally described situations in which only one vehicle is added or removed per cycle (e.g., one pass of a train or the like). However, some envisioned embodiments may provide for a dual (or more) transfer of vehicles per cycle. Such embodiments may place a turntable adjacent to a section of track that wraps around a larger portion of a perimeter of the turntable (rather than providing a single point of overlap/intersection) to support transfer, e.g., to provide a longer time period of engagement or proximity. For example, the turntable 470 may include two extensions or transfer arms 474 and perform two loads or unloads or one load and one unload per revolution of the turntable (with two being provided only as one example and more being feasible in some situations).

As discussed above with reference to FIGS. 2 and 3, a vehicle transfer assembly may include a control system with a user/operator interface or panel. This control system may be integrated with the ride control system or may be a separate control system. To provide controls, the algorithms discussed herein, such as with reference to FIGS. 2 and 3 and operation of the systems of FIGS. 1 and 4, may be implemented with computer, processing hardware, optical and other sensors, and other known electrical components for selectively operating transfer components such as the turntable motor and receiver/transfer mechanisms such as electromagnets and the like. In some embodiments, the vehicle sensors are proximity-based sensors that operate to see or sense a specific target (e.g., a receiver vehicle, a transfer vehicle with a passenger, or the like), and in operation, such sensors may be used by the control systems/controller to ensure that a vehicle is in a proper or synched position prior to finalizing transfer or initiating rotation of the turntable. For example, one useful proximity sensor may optically detect or see a metal (e.g., aluminum) or other material flag on a vehicle (receiver or transfer), while other vehicle or synchronization sensors may make use of Hall's Effect (e.g., magnetic force detection) sensors or optical sensors.

Capture and locking of a vehicle onto the receiver or on the turntable may be triggered by redundant positive validation of these position or vehicle sensors. In some embodiments, operation may be controlled such that if the controller (which may be implemented with hardware, software, or a combination thereof) does not receive a positive signal that the vehicle is in an expected or right position/place at the expected or right time, transfer is aborted by the controller such as with the turntable continuing on back around to a load position. While not shown, another way to provide the capture and lock function is to use actuated tapered pins to capture/lock a vehicle in place on the receiver and/or turntable. In such an embodiment, one arrangement would provide multiple pins with at least two of these being orthogonal to each other to fully constrain the vehicle.

Further regarding designs/functionality of transfer control system, the control system would function to control the speed of the turntable. Also, the control system would likely operate to control the acceleration and jerk to achieve proper synchronization and to provide passenger comfort, respectively. For example, under control, an S-curve acceleration profile may be used by a control system to smoothly bring the turntable up to speed. The S-curve and the speed of the train with the receiver would drive the timing of the trigger point (e.g., for starting the turntable). The S-curve may be created based on the acceleration and jerk profile that is desired by the ride designers. As discussed with reference to FIGS. 2 and 3, the transfer assembly typically would be operated or the control system configured to provide one or more "abort" points. This may be a pre-defined point that would decide whether to continue with an engage operation/process or whether to come to a controlled stop and abort until next time the transfer vehicle is in a trigger position (or even to stop the table and the train and provide operator and/or manual intervention to correct a mismatch or lack of proper synchronization).

Another control consideration may be the speed variation of the train due to weight, drive wheel wear, and other operating parameters/conditions that vary over time or even for each set of passengers and with maintenance that is performed. Also, in some omnimover type implementations the train may even vary in speed as passengers load and unload the train. Hence, some embodiments of the invention utilize real time determination of the speed of the train or approaching receiver (or at least with frequent periodicity). This may be performed just upstream of the assigned trigger location or vehicle sensors or may be performed near the turntable on an ongoing basis such that a ride speed is known and stored in memory of the controller to allow ongoing adjustment or setting of the speed (and/or acceleration and jerk) profile to be used for the turntable. In preferred embodiments, a very accurate, real time speed of the train at the point of engagement between the turntable and the receiver are used by the control system (or control module run by a CPU/processor) to accurately select acceleration, jerk, and/or speed of the turntable to provide synchronization.

Safety mechanisms may also be provided in vehicle transfer assemblies of the invention as well as rides incorporating such assemblies. For example, redundant operation of the engage mechanism may be desirable as well as redundant speed measurement devices and/or sensors along with redundant devices for determining position of the turntable. Also, operator safety is important and is typically provided, at least in part, in the design of the control system. For example, an embodiment of the invention may call for the operator to simply press a button or otherwise provide input to the control system that loading of a transfer vehicle is complete so "move the turntable as soon as the synchronization or trigger information is received indicating an oncoming empty receiver." If the time in between loading being completed and the turntable rotating is too great, an operator may tend to forget and may endanger themselves by walking into a path of the turntable or loaded vehicle. Safety features may be provided to mechanically block egress to dangerous positions and/or the control system may require a continuous press of the activation or load/unload button or indicator to require that the operator stays in a particular safe position such as near the control panel.

We claim:

1. An assembly for transferring vehicles to and from an amusement park ride, which operates to convey a train of vehicles along a track at a set ride speed without interruption for loading and unloading of the vehicles in the train, comprising:

a transfer vehicle with a body for receiving one or more passengers;

a vehicle receiver positioned in the train of vehicles on the track, the vehicle receiver including a connection mechanism operable to selectively capture and release the transfer vehicle;

a turntable positioned adjacent to the track that is operable to rotate about a central hub at a rotation rate, wherein the turntable comprises an engagement mechanism at a position on the periphery of the turntable that is operable to selectively capture and release the transfer vehicle and wherein the rotation rate is selected based on the ride speed to synchronize the rotation of the turntable with travel of the train of vehicles to place the turntable engagement mechanism proximate to the connection mechanism of the vehicle receiver; and a ride control system with a sensor sensing a position of the vehicle receiver on the track relative to the turntable and, in response, operating the turntable to rotate at the rotation rate to provide the synchronized rotation with the travel of the train of vehicles, wherein the ride control system further comprises a sensor for determining when the turntable engagement mechanism is proximate to the connection mechanism of the vehicle receiver and wherein, in response, the ride control system operates the turntable engagement mechanism and the connection mechanism of the vehicle receiver to transfer the transfer vehicle between the turntable and the vehicle receiver.

2. The assembly of claim 1, wherein the ride control system further comprises a speed determination module run by a processor for determining a ride speed at a time proximate to a time when the turntable is operated to rotate, the ride control system further comprises a module run by the processor to select the rotation rate based upon the determined ride speed.

3. The assembly of claim 1, wherein the turntable comprises a transfer arm extending outward beyond a diameter of the turntable to extend outward into a path of travel of the train of vehicles and wherein the engagement mechanism is provided at an end of the transfer arm.

4. The assembly of claim 1, wherein the transfer vehicle comprises a connection plate extending from the body that is formed of a material that is attracted to magnetic fields and wherein the connection mechanism and the engagement mechanism each comprise an electromagnet that is selectively operated to capture and release the connection plate of the transfer vehicle, whereby when one of the electromagnets of the connection and engagement mechanisms is operated the transfer vehicle is transferred between the vehicle receiver and the turntable.

5. The assembly of claim 4, wherein the vehicle receiver and the turntable are configured such that when the turntable engagement mechanism and the connection mechanism of the vehicle receiver are placed in proximity the connection plate is disposed between the electromagnets of the mechanisms.

6. The assembly of claim 5, wherein the transfer vehicle further comprises a stabilizer element extending outward from the body and including lock receiver surfaces and wherein the vehicle receiver includes a receiving surface configured to mate with the stabilizer element and further includes a locking mechanism operable to be actuated to extend into the lock receiver surfaces of the stabilizer element.

7. A track and vehicle assembly, comprising:

a track assembly including a length of track upon which a plurality of vehicles are conveyed by a drive system at a ride speed including during loading and unloading of passengers into the vehicles;

a receiver positioned between two of the vehicles and connected to the drive system, the receiver comprising a receiving surface with a connection mechanism;

a transfer vehicle with a base adapted for selective attachment to the connection mechanism; and a transfer assembly with a transfer arm for releasably supporting the transfer vehicle, wherein the transfer assembly operates to position the transfer arm adjacent the receiving surface of the receiver whereby the transfer vehicle is transferred between the transfer arm and the receiving surface of the receiver with the receiver traveling substantially at the ride speed, wherein the transfer assembly comprises a turntable including the transfer arm and rotating about a central axis at a rotation rate selected based on the ride speed to synchronize the rotating of the turntable to achieve the positioning of the transfer arm adjacent the receiving surface of the receiver;

wherein the transfer assembly further comprises a control system operable in response to a synchronization signal indicating a position of the receiver relative to the turntable to initiate the rotating of the turntable; and wherein the connection mechanism on the receiving surface and the transfer arm are operable in response to transfer control signals from the control system to selectively operate to transfer the transfer vehicle between the receiver and the transfer assembly.

8. The assembly of claim 7, wherein the ride speed is less than about 2 feet per second and the transfer assembly is operable asynchronously relative to the drive system, whereby the transfer arm is locked at least temporarily in a load position to allow loading and unloading of passengers into the transfer vehicle when supported by the transfer arm.

9. The assembly of claim 7, wherein the transfer control signals are transmitted by the control system in response to detection by a sensor of positioning of the transfer vehicle adjacent at least one of the receiving surface of the receiver and the transfer arm.

10. The assembly of claim 7, wherein the transfer arm includes an electromagnet, the connection mechanism comprises an electromagnet, and the base comprises a magnetic plate formed of material attracted to operating ones of the electromagnets for selective attachment or release from transfer arm and the receiver.

11. The assembly of claim 7, further comprises an additional one of the transfer vehicles and an additional one of the vehicle receivers, wherein the turntable comprises an additional one of the engagement mechanism and the turntable is operable in a single cycle to capture one of the transfer vehicles from one of the vehicle receivers positioned in the train and to release the other one of the transfer vehicles onto the other one of the vehicle receivers in the train.

12. A method of transferring vehicles to a moving amusement park ride such as an omnimover-type ride, comprising:

providing a receiver vehicle within a train of ride vehicles, the train being conveyed at a substantially continuous velocity on a track and the receiver vehicle including a connection mechanism;

loading a vehicle body with a passenger, wherein the vehicle body is supported upon a turntable positioned adjacent the track and locked into a stationary load position;

determining with a sensor when the receiver vehicle passes a synchronization point on the track;

after the determining, rotating the turntable at a rotation rate set based on the velocity of the train to position the vehicle body in proximity to the connection mechanism on the receiver vehicle; and operating the connection mechanism to connect to and support the vehicle body on the receiver vehicle, wherein the connection mechanism comprises an electromagnetic and the operating comprises energizing the electromagnetic to apply attractive magnetic forces to a plate extending out from the vehicle body.

13. The method of claim 12, wherein the turntable comprises a transfer arm extending outward from the periphery of the turntable and wherein an engagement mechanism is provided on the transfer arm that is operable to support the vehicle body during the loading and the rotating steps and to release the vehicle body during or after the operating of the connection mechanism to the vehicle body.

14. The method of claim 13, wherein the engagement mechanism comprises an electromagnet selectively energized to support and release the vehicle body.

15. The method of claim 13, wherein the rotating of the turntable is continued after the operating of the connection mechanism until the transfer arm is determined to be in a load position spaced apart from the track.

16. The method of claim 13, further comprising determining with the sensor when the vehicle carrying the vehicle body passes a synchronization point on the track, rotating the turntable at the rotation rate to position the engagement mechanism of the transfer arm in proximity of the vehicle body, and operating the connection mechanism and the engagement mechanism to transfer the vehicle body from the receiver vehicle to the transfer arm of the turntable.

17. An assembly for transferring vehicles to and from an amusement park ride, which is operates to convey a train of vehicles along a track at a set ride speed without interruption for loading and unloading of the vehicles in the train, comprising:

a transfer vehicle with a body for receiving one or more passengers;

a vehicle receiver positioned in the train of vehicles on the track, the vehicle receiver including a connection mechanism operable to selectively capture and release the transfer vehicle;

a turntable positioned adjacent to the track that is operable to rotate about a central hub at a rotation rate, wherein the turntable comprises an engagement mechanism at a position on the periphery of the turntable that is operable to selectively capture and release the transfer vehicle and wherein the rotation rate is selected based on the ride speed to synchronize the rotation of the turntable with travel of the train of vehicles to place the turntable engagement mechanism proximate to the connection mechanism of the vehicle receiver; and a ride control system with a sensor sensing a position of the vehicle receiver on the track relative to the turntable and, in response, operating the turntable to rotate at the rotation rate to provide the synchronized rotation with the travel of the train of vehicles, wherein the ride control system further comprises a speed determination module run by a processor for determining a ride speed at a time proximate to a time when the turntable is operated to rotate, the ride control system further comprises a module run by the processor to select the rotation rate based upon the determined ride speed.

18. The assembly of claim 17, wherein the turntable comprises a transfer arm extending outward beyond a diameter of the turntable to extend outward into a path of travel of the train of vehicles and wherein the engagement mechanism is provided at an end of the transfer arm.

19. The assembly of claim 17, wherein the transfer vehicle comprises a connection plate extending from the body that is formed of a material that is attracted to magnetic fields and wherein the connection mechanism and the engagement mechanism each comprise an electromagnet that is selectively operated to capture and release the connection plate of the transfer vehicle, whereby when one of the electromagnets of the connection and engagement mechanisms is operated the transfer vehicle is transferred between the vehicle receiver and the turntable.

20. The assembly of claim 19, wherein the vehicle receiver and the turntable are configured such that when the turntable engagement mechanism and the connection mechanism of the vehicle receiver are placed in proximity the connection plate is disposed between the electromagnets of the mechanisms.

21. The assembly of claim 20, wherein the transfer vehicle further comprises a stabilizer element extending outward from the body and including lock receiver surfaces and wherein the vehicle receiver includes a receiving surface configured to mate with the stabilizer element and further includes a locking mechanism operable to be actuated to extend into the lock receiver surfaces of the stabilizer element.

22. An assembly for transferring vehicles to and from an amusement park ride, which is operates to convey a train of vehicles along a track at a set ride speed without interruption for loading and unloading of the vehicles in the train, comprising:

a transfer vehicle with a body for receiving one or more passengers;

a vehicle receiver positioned in the train of vehicles on the track, the vehicle receiver including a connection mechanism operable to selectively capture and release the transfer vehicle; and a turntable positioned adjacent to the track that is operable to rotate about a central hub at a rotation rate, wherein the turntable comprises an engagement mechanism at a position on the periphery of the turntable that is operable to selectively capture and release the transfer vehicle and wherein the rotation rate is selected based on the ride speed to synchronize the rotation of the turntable with travel of the train of vehicles to place the turntable engagement mechanism proximate to the connection mechanism of the vehicle receiver, wherein the turntable comprises a transfer arm extending outward beyond a diameter of the turntable to extend outward into a path of travel of the train of vehicles and wherein the engagement mechanism is provided at an end of the transfer arm.

23. The assembly of claim 22, further comprising a ride control system with a sensor sensing a position of the vehicle receiver on the track relative to the turntable and, in response, operating the turntable to rotate at the rotation rate to provide the synchronized rotation with the travel of the train of vehicles.

24. The assembly of claim 22, wherein the transfer vehicle comprises a connection plate extending from the body that is formed of a material that is attracted to magnetic fields and wherein the connection mechanism and the engagement mechanism each comprise an electromagnet that is selectively operated to capture and release the connection plate of the transfer vehicle, whereby when one of the electromagnets of the connection and engagement mechanisms is operated the transfer vehicle is transferred between the vehicle receiver and the turntable.

25. The assembly of claim 24, wherein the vehicle receiver and the turntable are configured such that when the turntable engagement mechanism and the connection mechanism of the vehicle receiver are placed in proximity the connection plate is disposed between the electromagnets of the mechanisms.

26. The assembly of claim 25, wherein the transfer vehicle further comprises a stabilizer element extending outward from the body and including lock receiver surfaces and wherein the vehicle receiver includes a receiving surface configured to mate with the stabilizer element and further includes a locking mechanism operable to be actuated to extend into the lock receiver surfaces of the stabilizer element.

27. An assembly for transferring vehicles to and from an amusement park ride, which is operates to convey a train of vehicles along a track at a set ride speed without interruption for loading and unloading of the vehicles in the train, comprising:

a transfer vehicle with a body for receiving one or more passengers;

a vehicle receiver positioned in the train of vehicles on the track, the vehicle receiver including a connection mechanism operable to selectively capture and release the transfer vehicle; and a turntable positioned adjacent to the track that is operable to rotate about a central hub at a rotation rate, wherein the turntable comprises an engagement mechanism at a position on the periphery of the turntable that is operable to selectively capture and release the transfer vehicle and wherein the rotation rate is selected based on the ride speed to synchronize the rotation of the turntable with travel of the train of vehicles to place the turntable engagement mechanism proximate to the connection mechanism of the vehicle receiver, wherein the transfer vehicle comprises a connection plate extending from the body that is formed of a material that is attracted to magnetic fields and wherein the connection mechanism and the engagement mechanism each comprise an electromagnet that is selectively operated to capture and release the connection plate of the transfer vehicle, whereby when one of the electromagnets of the connection and engagement mechanisms is operated the transfer vehicle is transferred between the vehicle receiver and the turntable.

28. The assembly of claim 27, further comprising a ride control system with a sensor sensing a position of the vehicle receiver on the track relative to the turntable and, in response, operating the turntable to rotate at the rotation rate to provide the synchronized rotation with the travel of the train of vehicles.

29. The assembly of claim 27, wherein the vehicle receiver and the turntable are configured such that when the turntable engagement mechanism and the connection mechanism of the vehicle receiver are placed in proximity the connection plate is disposed between the electromagnets of the mechanisms.

30. The assembly of claim 29, wherein the transfer vehicle further comprises a stabilizer element extending outward from the body and including lock receiver surfaces and wherein the vehicle receiver includes a receiving surface configured to mate with the stabilizer element and further includes a locking mechanism operable to be actuated to extend into the lock receiver surfaces of the stabilizer element.

31. A track and vehicle assembly, comprising:

a track assembly including a length of track upon which a plurality of vehicles are conveyed by a drive system at a ride speed including during loading and unloading of passengers into the vehicles;

a receiver positioned between two of the vehicles and connected to the drive system, the receiver comprising a receiving surface with a connection mechanism;

a transfer vehicle with a base adapted for selective attachment to the connection mechanism; and a transfer assembly with a transfer arm for releasably supporting the transfer vehicle, wherein the transfer assembly operates to position the transfer arm adjacent the receiving surface of the receiver whereby the transfer vehicle is transferred between the transfer arm and the receiving surface of the receiver with the receiver traveling substantially at the ride speed, wherein the transfer arm includes an electromagnet, the connection mechanism comprises an electromagnet, and the base comprises a magnetic plate formed of material attracted to operating ones of the electromagnets for selective attachment or release from transfer arm and the receiver.

32. The assembly of claim 31, wherein the ride speed is less than about 2 feet per second and the transfer assembly is operable asynchronously relative to the drive system, whereby the transfer arm is locked at least temporarily in a load position to allow loading and unloading of passengers into the transfer vehicle when supported by the transfer arm.

33. The assembly of claim 31, wherein the transfer assembly comprises a turntable including the transfer arm and rotating about a central axis at a rotation rate selected based on the ride speed to synchronize the rotating of the turntable to achieve the positioning of the transfer arm adjacent the receiving surface of the receiver.

34. The assembly of claim 33, wherein the transfer assembly further comprises a control system operable in response to a synchronization signal indicating a position of the receiver relative to the turntable to initiate the rotating of the turntable.

35. The assembly of claim 34, wherein the connection mechanism on the receiving surface and the transfer arm are operable in response to transfer control signals from the control system to selectively operate to transfer the transfer vehicle between the receiver and the transfer assembly and, further, wherein the transfer control signals are transmitted by the control system in response to detection by a sensor of positioning of the transfer vehicle adjacent at least one of the receiving surface of the receiver and the transfer arm.

36. The assembly of claim 31, further comprises an additional one of the transfer vehicles and an additional one of the vehicle receivers, wherein the turntable comprises an additional one of the engagement mechanism and the turntable is operable in a single cycle to capture one of the transfer vehicles from one of the vehicle receivers positioned in the train and to release the other one of the transfer vehicles onto the other one of the vehicle receivers in the train.

37. A track and vehicle assembly, comprising:

a track assembly including a length of track upon which a plurality of vehicles are conveyed by a drive system at a ride speed including during loading and unloading of passengers into the vehicles;

a receiver positioned between two of the vehicles and connected to the drive system, the receiver comprising a receiving surface with a connection mechanism;

a transfer vehicle with a base adapted for selective attachment to the connection mechanism;

a transfer assembly with a transfer arm for releasably supporting the transfer vehicle, wherein the transfer assembly operates to position the transfer arm adjacent the receiving surface of the receiver whereby the transfer vehicle is transferred between the transfer arm and the receiving surface of the receiver with the receiver traveling substantially at the ride speed; and an additional one of the transfer vehicles and an additional one of the vehicle receivers, wherein the turntable comprises an additional one of the engagement mechanism and the turntable is operable in a single cycle to capture one of the transfer vehicles from one of the vehicle receivers positioned in the train and to release the other one of the transfer vehicles onto the other one of the vehicle receivers in the train.

38. The assembly of claim 37, wherein the ride speed is less than about 2 feet per second and the transfer assembly is operable asynchronously relative to the drive system, whereby the transfer arm is locked at least temporarily in a load position to allow loading and unloading of passengers into the transfer vehicle when supported by the transfer arm.

39. The assembly of claim 37, wherein the transfer assembly comprises a turntable including the transfer arm and rotating about a central axis at a rotation rate selected based on the ride speed to synchronize the rotating of the turntable to achieve the positioning of the transfer arm adjacent the receiving surface of the receiver.

40. The assembly of claim 39, wherein the transfer assembly further comprises a control system operable in response to a synchronization signal indicating a position of the receiver relative to the turntable to initiate the rotating of the turntable.

41. The assembly of claim 40, wherein the connection mechanism on the receiving surface and the transfer arm are operable in response to transfer control signals from the control system to selectively operate to transfer the transfer vehicle between the receiver and the transfer assembly and, further, wherein the transfer control signals are transmitted by the control system in response to detection by a sensor of positioning of the transfer vehicle adjacent at least one of the receiving surface of the receiver and the transfer arm.

42. A method of transferring vehicles to a moving amusement park ride such as an omnimover-type ride, comprising:

providing a receiver vehicle within a train of ride vehicles, the train being conveyed at a substantially continuous velocity on a track and the receiver vehicle including a connection mechanism;

loading a vehicle body with a passenger, wherein the vehicle body is supported upon a turntable positioned adjacent the track and locked into a stationary load position;

determining with a sensor when the receiver vehicle passes a synchronization point on the track;

after the determining, rotating the turntable at a rotation rate set based on the velocity of the train to position the vehicle body in proximity to the connection mechanism on the receiver vehicle; and operating the connection mechanism to connect to and support the vehicle body on the receiver vehicle, wherein the turntable comprises a transfer arm extending outward from the periphery of the turntable and wherein an engagement mechanism is provided on the transfer arm that is operable to support the vehicle body during the loading and the rotating steps and to release the vehicle body during or after the operating of the connection mechanism to the vehicle body.

43. The method of claim 42, wherein the engagement mechanism comprises an electromagnet selectively energized to support and release the vehicle body.

44. The method of claim 42, wherein the rotating of the turntable is continued after the operating of the connection mechanism until the transfer arm is determined to be in a load position spaced apart from the track.

45. The method of claim 42, further comprising determining with the sensor when the vehicle carrying the vehicle body passes a synchronization point on the track, rotating the turntable at the rotation rate to position the engagement mechanism of the transfer arm in proximity of the vehicle body, and operating the connection mechanism and the engagement mechanism to transfer the vehicle body from the receiver vehicle to the transfer arm of the turntable.

* * * * *